US007112257B2

(12) United States Patent
Baggot et al.

(10) Patent No.: US 7,112,257 B2
(45) Date of Patent: Sep. 26, 2006

(54) METHOD OF MECHANICAL SOFTENING OF SHEET MATERIAL

(75) Inventors: James L. Baggot, Menasha, WI (US); Ronald Gropp, St. Catherines (CA); Kevin Berkebile, Middletown, DE (US); Kurt Otto, New London, WI (US); Bernhardt E. Kressner, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/752,857

(22) Filed: Jan. 7, 2004

(65) Prior Publication Data

US 2004/0229067 A1 Nov. 18, 2004

Related U.S. Application Data

(60) Division of application No. 09/551,282, filed on Apr. 18, 2000, now Pat. No. 6,755,937, which is a continuation of application No. 08/994,556, filed on Dec. 19, 1997, now abandoned.

(51) Int. Cl.
*D21H 11/00* (2006.01)

(52) U.S. Cl. ..... 162/109; 162/116; 451/28

(58) Field of Classification Search ..... 162/109, 162/113, 116; 451/28
See application file for complete search history.

(56) References Cited

U.S. PATENT DOCUMENTS

| | | | | |
|---|---|---|---|---|
| 2,708,303 | A | 5/1955 | Walton et al. | |
| 2,761,490 | A | 9/1956 | Walton | |
| 2,950,223 | A | 8/1960 | Bletzinger et al. | |
| 3,066,046 | A | 11/1962 | Walton | |
| 3,101,520 | A | 8/1963 | George et al. | |
| 3,112,632 | A | 12/1963 | Walton | |
| 3,132,502 | A | 5/1964 | Walton | |
| 3,168,307 | A | 2/1965 | Walton et al. | |
| 3,168,308 | A | 2/1965 | Walton et al. | |
| 3,197,791 | A | 8/1965 | Walton | |
| 3,220,056 | A | 11/1965 | Walton | |
| 3,220,057 | A | 11/1965 | Walton | |
| 3,260,778 | A | 7/1966 | Walton | |
| 3,301,746 | A | 1/1967 | Sanford et al. | |
| 3,337,388 | A * | 8/1967 | Wosaba II | 428/92 |
| 3,356,237 | A | 12/1967 | Walton | |
| 3,369,803 | A | 2/1968 | Walton et al. | |
| 3,389,906 | A | 6/1968 | Walton | |
| 3,406,961 | A | 10/1968 | Walton | |
| 3,406,966 | A | 10/1968 | Walton | |
| 3,426,405 | A | 2/1969 | Walton | |
| 3,476,119 | A | 11/1969 | Walton | |
| 3,531,103 | A | 9/1970 | Walton | |

(Continued)

FOREIGN PATENT DOCUMENTS

| | | |
|---|---|---|
| CA | 1146396 | 5/1983 |

(Continued)

OTHER PUBLICATIONS

Office Action from corresponding Canadian Application No. 2,248,727, dated Jan. 17, 2005, 5 pages.

(Continued)

*Primary Examiner*—Dionne W. Mayes
(74) *Attorney, Agent, or Firm*—Brinks Hofer Gilson & Lione

(57) ABSTRACT

New and improved methods and products are disclosed relating to softness of fibrous webs. Increased softness, among other things, is obtained by abrading the surface of the web to create fuzziness from protruding fibers.

10 Claims, 12 Drawing Sheets

U.S. PATENT DOCUMENTS

| | | | | | |
|---|---|---|---|---|---|
| 3,563,623 | A | | 2/1971 | Walton | |
| 3,592,026 | A | | 7/1971 | Walton | |
| 3,592,732 | A | | 7/1971 | Wand | |
| 3,683,559 | A | * | 8/1972 | Kalwaites | 451/188 |
| 3,869,768 | A | | 3/1975 | Walton et al. | |
| 3,910,287 | A | | 10/1975 | Walton | |
| 3,975,806 | A | | 8/1976 | Walton et al. | |
| 3,994,771 | A | * | 11/1976 | Morgan et al. | 162/113 |
| 4,142,278 | A | | 3/1979 | Walton et al. | |
| 4,300,981 | A | | 11/1981 | Carstens | |
| 4,627,849 | A | | 12/1986 | Walton et al. | |
| 4,641,827 | A | | 2/1987 | Walton et al. | |
| 4,645,193 | A | | 2/1987 | Walton et al. | |
| 4,748,923 | A | | 6/1988 | Walton et al. | |
| 4,785,644 | A | | 11/1988 | Walton et al. | |
| 4,806,300 | A | | 2/1989 | Walton et al. | |
| 4,859,169 | A | | 8/1989 | Walton et al. | |
| 4,892,298 | A | | 1/1990 | Walton et al. | |
| 4,894,196 | A | | 1/1990 | Walton et al. | |
| 4,921,643 | A | | 5/1990 | Walton et al. | |
| 5,060,349 | A | | 10/1991 | Walton et al. | |
| 5,117,540 | A | | 6/1992 | Walton et al. | |
| 5,149,332 | A | | 9/1992 | Walton et al. | |
| 5,180,471 | A | * | 1/1993 | Sauer et al. | 162/112 |
| 5,607,551 | A | | 3/1997 | Farrington, Jr. et al. | |
| 5,752,300 | A | * | 5/1998 | Dischler | 26/28 |

FOREIGN PATENT DOCUMENTS

| | | | | |
|---|---|---|---|---|
| CH | 595821 | * | 10/1977 | 162/109 |
| CH | 595 821 | | 2/1978 | |
| GB | 1 117 731 | | 6/1968 | |

OTHER PUBLICATIONS

US 5,495,647, 03/1996, Walton et al. (withdrawn)

* cited by examiner

Fig. 3
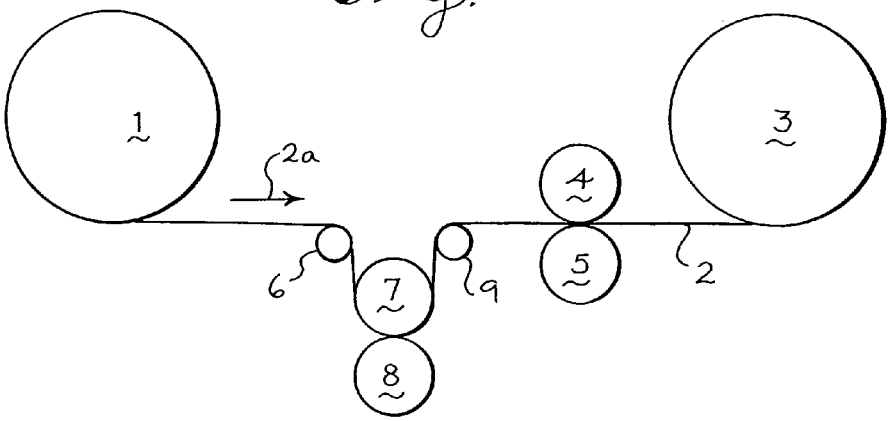
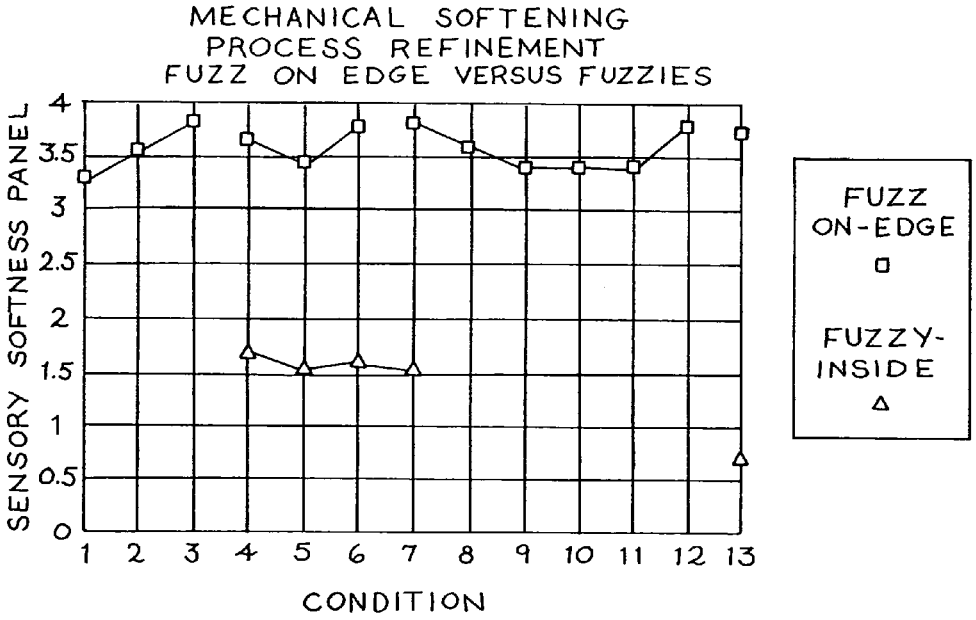
Fig. 4

Fig. 11
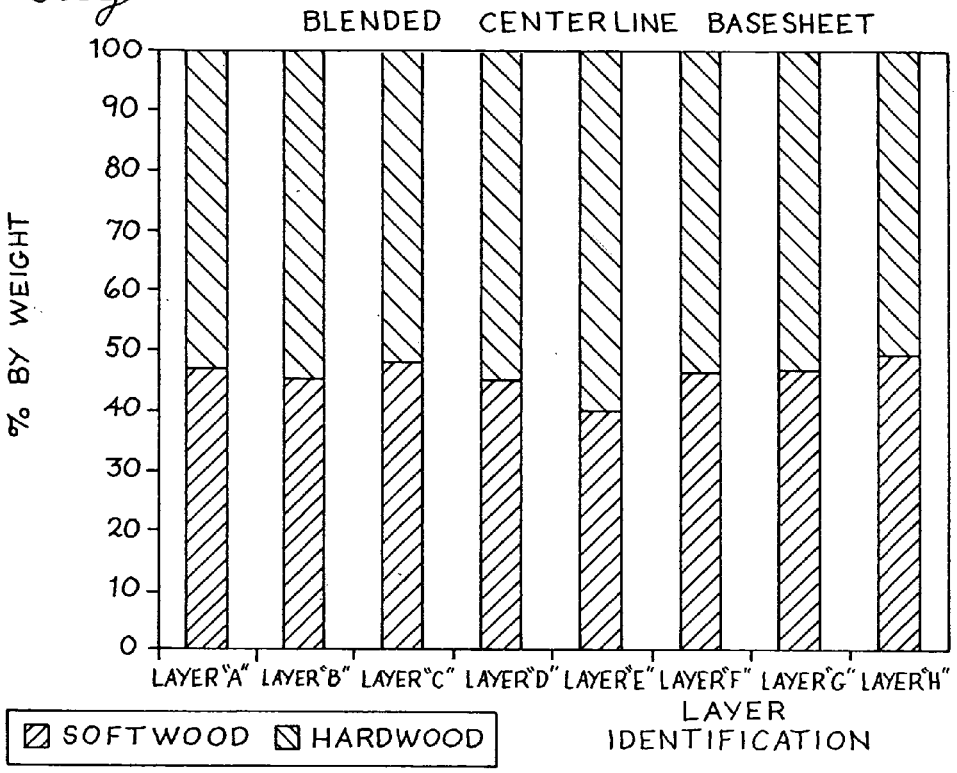
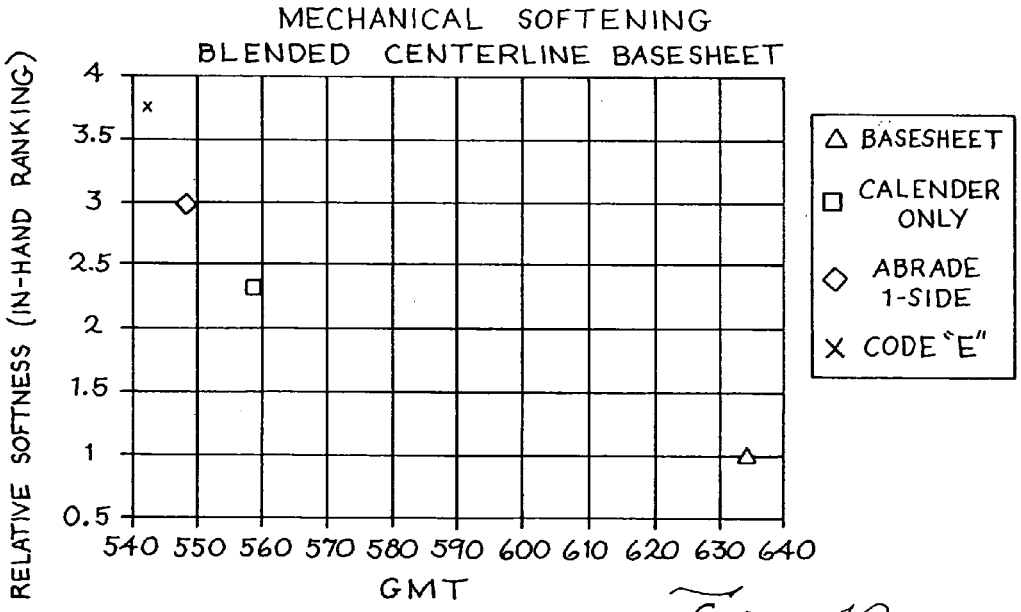
Fig. 12

METHOD OF MECHANICAL SOFTENING OF SHEET MATERIAL

This application is a division of application Ser. No. 09/551,282, filed on Apr. 18, 2000, now U.S. Pat. No. 6,755,937, issued on Jun. 29, 2004, which is a continuation of application Ser. No. 08/994,556, filed Dec. 19, 1997, (now abandoned), the disclosures of which are hereby incorporated by reference herein.

FIELD OF THE INVENTION

This invention relates to the mechanical softening of material that is in sheet form, such as paper sheets and the methods of manufacturing them. More particularly, this invention relates to tissue and towels that have increased softness.

BACKGROUND OF THE INVENTION

The type and amount of fibers that extend out of a sheet have been known to effect the perceived softness of that sheet. Although, tissue sheets are principally discussed herein, it should be recognized that this invention is not limited to tissue sheets or products, but may be applicable to any type of paper product, as well as other types of material, such as non-woven and woven fabrics, where softness or the amount of loose fibers on the surface of the product is desirable. All other factors remaining equal, a tissue sheet that has more loose fibers on its surface, i.e., one that is fuzzier, should be perceived as being softer than a tissue sheet that has less loose fibers on its surface. By loose fibers as used herein, it is meant that one end of the fiber is not bonded to other fibers in the tissue sheet and is protruded above the bonded surface of the sheet. The desirability of increasing the number of loose fibers on the surface of a sheet to increase perceived softness has been know. For example, Wand. U.S. Pat. No. 3,592,732, discloses using a brush to lift the fibers from the surface of a tissue or towel sheet to increase softness.

SUMMARY OF THE INVENTION

This invention is an improvement over the prior art in the type, and technique, of mechanical softening and in the product that is obtained. The apparatus and techniques of the present invention provide an improvement in production speed and efficiency. In one embodiment, a new tissue product is further provided that has selectively raised fibers over only a portion of the sheet surface. Such tissue product can be obtained by using the abrading apparatus and techniques on an uncreped through air dried tissue, such as those disclosed in U.S. Pat. No. 5,607,551, and copending U.S. patent application Ser. No. 08/310,186 filed Sep. 21, 1994, the disclosures of which are incorporated herein by reference.

In one embodiment of the invention there is provided a soft tissue product having increased surface fuzziness formed by abrading a tissue product comprising one or more tissue plies and having a MD Max Slope of about 10 or less.

In an alternative embodiment of the invention there is provided a soft tissue product having increased surface fuzziness formed by abrading an uncreped through dried web comprising at least about 10 dry weight percent high yield pulp fibers and wet:dry geometric mean tensile ration of about 0.1 or greater.

In an alternative embodiment of the invention there is provided a soft tissue sheet comprising: a first surface and a second surface; each surface comprising paper making fibers; and, at least one of the surfaces having selectively loosened areas of paper making fibers.

In an alternative embodiment of the invention there is provided a soft paper product comprising: a first layer and a second layer, the layers each comprising paper making fibers; a first and a second surface, the first surface corresponding to the surface of the first layer and the second surface corresponding to the surface of the second layer; and, at least one of the surfaces having loosened fibers thereon.

In an alternative embodiment of the invention there is provided a soft sheet product having a machine direction tensile strength of at least about 1000 grams per 3 inches and a cross-machine direction tensile strength of at least about 800 grams per 3 inches and comprising: a first surface and a second surface, each surface comprising fibers; and, at least one of the surfaces having substantial loosened fibers thereon.

In an alternative embodiment of the invention there is provided a paper sheet having an improved rate of absorbency comprising: a first sheet surface and a second sheet surface; a layer comprising paper making fibers; the layer having a surface; the surface of the layer corresponding to a surface of the paper sheet; the surface of the layer having abraded fibers; and the rate of absorbency of the sheet being greater than a sheet of similar composition but not having abraded fibers on its surface and the amount of absorbency for the sheet being comparable to the similar non-abraded sheet.

In an alternative embodiment of the invention there is provided a soft paper product comprising a layer; the layer comprising long papermaking fibers; the layer having a surface; the surface having a PR/EL of greater than about 0.72, or greater than about 1, and in which the surface layer has at least about 20% of the fields of view having a PR/EL ratio of about 2 or greater.

In yet a further embodiment of the present invention there is provided a method of making a sheet product having improved softness comprising: obtaining a web of fibrous material in sheet form feeding the web into an abrasion apparatus comprising: a pressure device; a backing roll; an abrasion roll; and abrading the surface of the web with the abrasion roll.

In an alternative embodiment of the invention there is provided a method of treating a paper web comprising: feeding a web of paper comprising papermaking fibers into a nip formed by a first and a second roller; the nip applying pressure to the web to hold the web against the second roller; the web partially wrapping and moving around and with the second roller; a third roller contacting the web while the web is against the second roller and the third roller having a rough surface; and, the third roller rotating while in contact with the web to loosen the fibers on the surface of the web.

In an alternative embodiment of the invention there is provided a method of treating a paper web comprising: obtaining a web of paper comprising papermaking fibers; bringing the paper web in contact with a first roller; holding the web against the first roller; the web partially wrapping and moving around and with the first roller; a second roller contacting the web while the web is in contact against the first roller, the second roller having a rough surface; and, the second roller rotating while in contact with the web to loosen the fibers on the surface of the web.

In yet a further embodiment of the present invention there is provided an apparatus to treat webs of fibrous material comprising: a first roller; a second roller; a tensioning device; a frame to hold the rollers and device in a set relationship; the tensioning device positioned adjacent the first roller; the second roller positioned near the first roller, and set a distance of from about 0.006 inches to about 0.008 inches from the first roller; and, the second roller having an abrading surface of sufficient roughness to loosen fibers, only on the surface of the web being treated.

Mechanical softening by abrading the surface of a tissue sheet improves the feel of the sheet as perceived by the consumer or end user. Abrading works the surface of the sheet causing partial debonding of surface fibers giving rise to loose fiber ends on that surface, but without reducing the central strength of the sheet. Some potential advantages that may be obtained by abrading a tissue sheet include:

1) improved customer product perception in hand and in use for a given sheet;

2) reduced chemical costs by reducing the amount of chemical debonders required in the tissue and particularly in the outside layer of a multilayered tissue;

3) reduced fibers costs, including a reduction in the use of higher cost fiber processing, such as curling fibers;

4) improved strength for a given perceived softness;

5) reduced sidedness in a one-ply tissue or other one-ply webs;

6) reduced calender loading pressures, which would allow for less bulk reduction of the tissue during manufacturing; and, 7) improved rate of absorbency.

DRAWINGS

FIG. 3 is a schematic of an alternative embodiment of an abrading apparatus and process flow for abrading prior to calendering.

FIG. 4 is a photograph at 40× magnification of a contemporaneous calendered only tissue that has not been softened by the invention, and having an average PR/EL of 0.71.

FIG. 11 is a graph charting data.

FIG. 12 is a graph charting data.

DETAILED DESCRIPTION OF PRESENTLY PREFERRED EMBODIMENTS OF THE INVENTION

Figure 1:
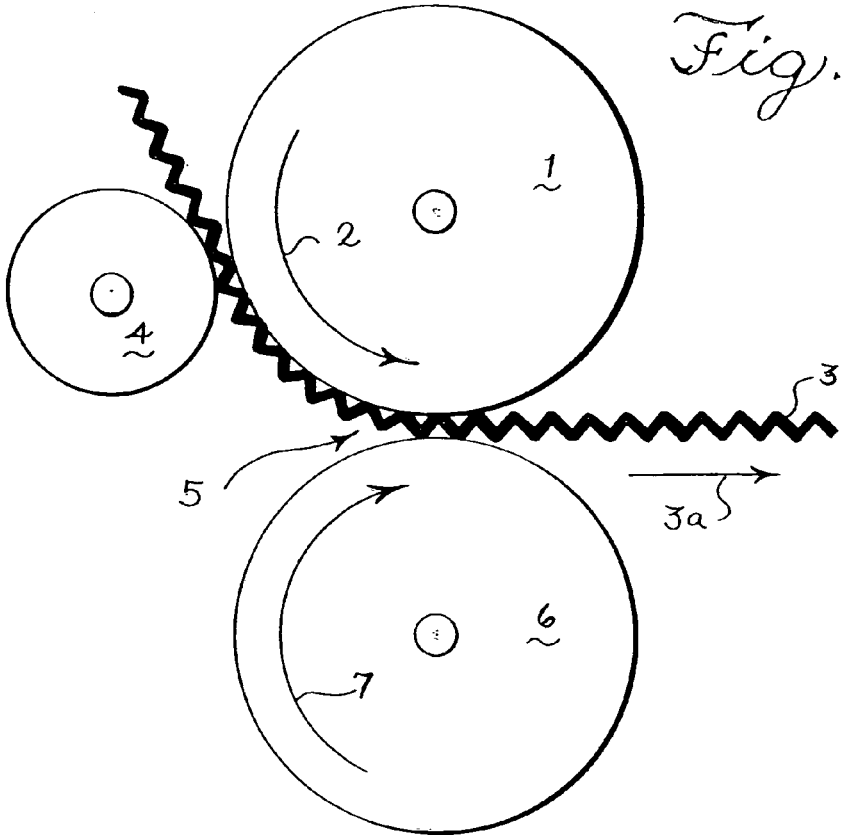
FIG. 1 is a schematic of an abrading apparatus and process flow showing the abrasion roll and sheet moving in the same direction.

Generally, in the apparatus used to mechanically soften a sheet, the sheet is controlled by a back-up assembly that has a backing roll positioned opposite an abrasion roll. This assembly holds the sheet while the abrasion takes place, thereby reducing tensions in the sheet upstream and downstream from the abrasion roll. Thus, the sheet is held stable and restrained while being abraded so that power can be input to the surface of the sheet and so that the input of power to the sheet is independent of the strength and stretch level of the sheet.

Mechanical softening by abrasion can be done on any type of sheet material, such as paper sheets that will be used for facial tissue, bath tissue, towels, hand towels and wipers. Further, the paper sheet can be made of long paper making fibers (softwood), short paper making fibers (hardwood), secondary fibers, synthetic fibers, or any combination of these or other fibers known to those skilled in the art of paper making to be useful in making paper. Long paper making fibers are generally understood to have a length of about 2 mm or greater. Especially suitable hardwood fibers include eucalyptus and maple fibers. It is also contemplated that the sheet can have as much as 100% secondary fibers.

As used herein, and unless specified otherwise, the term sheet refers generally to any type of paper sheet, e.g., tissue, towel or a heavier basis weight product, creped or uncreped, multilayer or single layered, and multiplied or singleplied. It is also contemplated that this process could be used to increase the softness and number of loose fibers on other types of sheet material such as non-woven air laid products and woven natural or synthetic products or any other fiber-based sheet material.

Generally, the process to mechanically soften tissues sheets can be run at speeds up to 3000 fpm, although higher speeds may be possible. At a speed of 3000 fpm it is generally preferred that a maximum power input to the sheet should be about 17 hp. for a 104" wide sheet of tissue paper. It is also generally preferred for the work to be done on the sheet to be uniform across the sheet. At these speeds it is generally preferred that bulk variations of the sheet also be controlled and can be at about 5% or less, to obtain the maximum benefit of this process. The sheet can be abraded either before or after calendering and either one or both sides of the sheet can be abraded.

Although in the examples set fourth herein the abrasion is conducted as an off-machine operation, it is contemplated, and may be preferred, to have the abrasion take place on the paper machine. Thus, the abrasion apparatus could be located between the dryer and the reel of the paper machine. At this point in the paper making process, the sheet would be hot. Additionally, its moisture level would be lower than the ambient moisture levels of about 5–6% that were present in the off-machine abrasions set fourth in the examples. It is theorized that both the lower moisture and the increased temperature may make the surface fibers loosen more easily. Further, if an impermeable fabric carrying the sheet to the abrasion nip could be used, as the backing, instead of or in conjunction with, a rubber coated backing roll, the abrasion nip would be longer. This longer abrasion nip would give the sheet more dwell time, and likely result in either lower nip pressures, or less speed differential for the same results. Thus, with judicious placement of rolls under the fabric, and proper selection of fabric tension, the nip could be extended, and extended a substantial amount.

In another configuration of abrading on the machine, the abrasion apparatus would be located at the reel. In this configuration the abrasion roll would ride on the winding reel, with a controlled pressure. The sheet would be held in place by virtue of it being part of the roll of paper that was forming at the reel. Thus, the reel drum would function as the nip roller and the winding roll as the backing roll for the abrasion apparatus. Moreover, this configuration may be combined with the configuration where the abrasion apparatus is located between the dryer and the reel. Thus, allowing for both sides of the sheet to be abraded on machine.

Preferably dust levels also can be controlled to maintain acceptable operator health and cleanliness levels. It is also generally preferable that the process be designed so that the cost of operation is in the range of about a couple dollars per ton.

Generally, to obtain the maximum benefits of mechanical softening, the sheet prior to abrasion can have a thickness of at least 0.010", an MD (machine direction) strength of at least 750 grams/3 inches, and a MD stretch of at least 12%. (MD and CD strengths are tensile strength, and are reported in grams per 3 inches.) It is contemplated that there is no maximum upper or lower limit for the basis weight, and that there is no upper maximum limit for the thickness, strength or stretch of the sheet that can be mechanically softened by this process.

The MD Tensile Strength, MD Tensile Stretch, CD Tensile Strength and CD Tensile Stretch are obtained according to TAPPI Test Method 494 OM-88 "Tensile Breaking Properties of Paper and Paperboard" using the following parameters: Crosshead speed is 10.0 in/min. (254 mm/min), full scale load is 10 lb (4,540 g), jaw span (the distance between the jaws, sometimes referred to as the gauge length) is 2.0 inches (50.8 mm), specimen width is 3 inches (76.2 mm). A suitable tensile testing machine is a Sintech, Model CITS-2000 (Systems Integration Technology Inc., Stoughton, Mass.; a division of MTS Systems Corporation, Research Triangle Park, N.C.).

Figure 20:
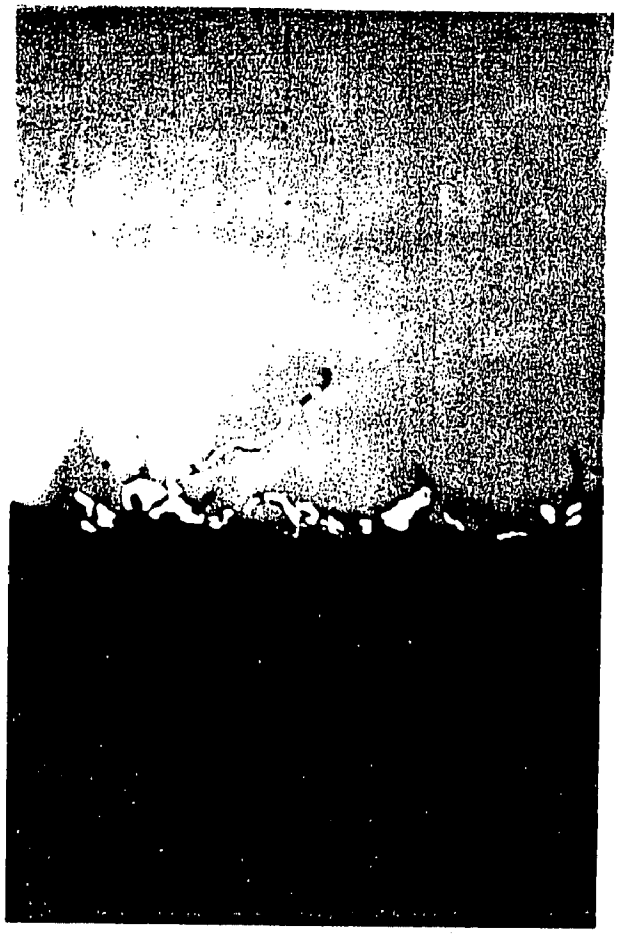
FIG. 20 is a photograph at 40× magnification of a mechanically softened uncreped through air dried tissue that was abraded on the air side only at an abrasion ratio of 1.5, a web speed of 2200 fpm, a gap of 0.006", and abrasion roll roughness of 250 Ra, and having an average PR/EL of 2.44.
Figure 21:
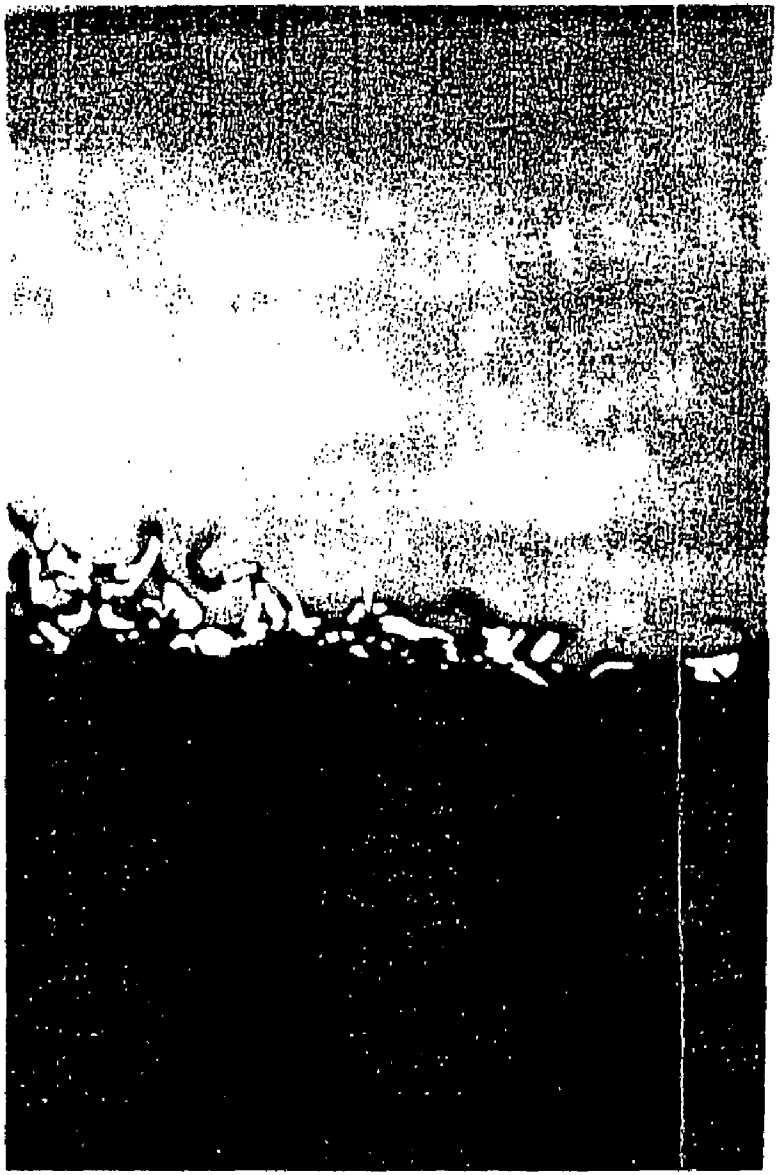
FIG. 21 is a photograph at 40× magnification of a mechanically softened uncreped through air dried tissue that was abraded on the air side only at an abrasion ratio of 2.0, a web speed of 1000 fpm, a gap of 0.012", and abrasion roll roughness of 250 Ra, and having an average PR/EL of 3.60.

A mechanically softened sheet will generally have a readily perceptible change in feel, becoming softer. The loose fibers created by abrading may be apparent to visual observation on the edge of the sheet when it is held to the light. They are also apparent when viewed under a microscope as can be seen in FIGS. 20 and 21. These two photographs can be compared to FIG. 4, which shows a contemporaneous tissue sheet that has not been surface abraded. It is believed that the absorbency rate of the sheet will generally increase, although the overall absorbency capacity of the sheet should remain the same. This change in absorbency rate may require the use of additional wet strength resin in certain applications.

The benefits of this invention can be obtained without appreciable reductions in strength or stretch levels of the sheet. Thus, it is generally preferable that the mechanical softening not reduce strength by more than 10% and MD stretch by more than 2%, although greater reductions in strength and stretch may occur, while still obtaining benefits of this invention. Further, it is generally preferred that the mechanical softening should have little effect on the bulk of the sheet, although it may improve roll firmness due to reduced nesting of the sheet.

FIG. 1 shows a schematic drawing of an embodiment of an apparatus to mechanically soften a sheet. In that figure a sheet 3 is moving in the direction of arrow 3*a*. A hard rubber backing roll 1 rotates in the direction of arrow 2 and at the same speed as sheet 3. To assist in controlling the tension of the sheet across the face of the backing roll, a rubber covered nip roll 4 is located prior to the abrasion nip 5. The abrasion nip 5 is formed by the backing roll 1 and an abrasion roll 6. The abrasion roll 6 rotates in the direction of arrow 7 and the same direction as sheet 3. The abrasion roll 6 rotates at a higher surface speed than the velocity of the sheet causing an abrading action at the sheet's surface. This abrading action raises the fibers on the sheet. The abrasion roll 6 can be a steel roll with a tungsten carbide coating. This configuration allows for a homogeneously controlled surface abrasion and better web tension control resulting in less sheet degradation while abrading.

For tissue the surface roughness of the abrasion roll can be from about 125 to 400 or more Ra (roughness average value in microinches (μin)). For other types of sheet, such as heavier towels, surface roughness as high as 2000 Ra may be needed to obtain the desired amount of loose fibers. For very delicate sheets, or in alternative configurations of the abrasion apparatus, a surface roughness of less than 125 Ra may be need to obtain the desired amount of loose fibers.

To obtain optimum benefits, the gap or interface between the abrasion roll 6 and the backing roll 1 should be maintained constant across the length of those rolls, i.e., in the cross machine (CD) direction. It is contemplated that the variation in this interface for tissue should be within 0.0002" to obtain the optimum benefits of this process. Equipment to obtain this type of accuracy in an interface between two rolls is known in the art. For example, a variable crown roll, having a 0.002" radial size change capability, that uses heat to control its size could be used.

Figure 2:
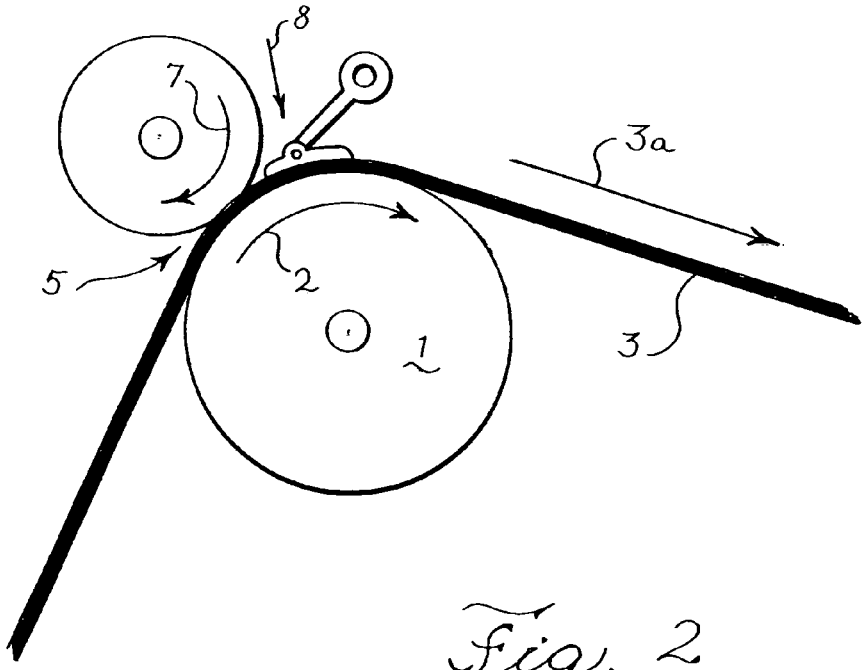
FIG. 2 is a schematic of an alternative embodiment of an abrading apparatus and process flow showing the abrasion roll and sheet moving in opposite directions.

FIG. 2 shows an alternative embodiment of an apparatus to mechanically soften a sheet. In this embodiment, instead of a nip roll to hold the sheet 3 against the backing roll while abrading, a mechanical device 8, is used to apply tension against the sheet to hold it against the backing roll 1. This mechanical device could be made from, or have a surface coating of, a low friction high wear material, and could be curved to match the curve of the backing roll 1. It could also be placed as close to the abrasion nip 5 as possible. In the embodiment show in FIG. 2, the backing roll 1 is rotating in the direction of arrow 2, the sheet is moving in the direction of arrow 3*a*, and the abrasion roll 6 is moving in the direction of arrow 7. In this embodiment, in which the abrasion roll is rotating in a direction opposite to the movement of the sheet, the mechanical device is located on the back side of the nip. If the abrasion roll where moving in the same direction as the sheet, as shown in the embodiment of FIG. 1, the mechanical device would be located on the front side of the abrasion nip.

A vacuum backing roll, a high friction backing roll, an air pressure system for applying air pressure to the sheet, or other such devices known to those skilled in the art of paper making could be used to provide traction to the sheet, preventing it from slipping relative to the backing roll.

FIG. 3 shows an other embodiment of a mechanical softening apparatus. In this embodiment, guide rolls 6 and 9 are used to provide wrap on the backing roll 7. Tension created in the web by running the unwinder 1 slower and the winder 3 faster than the backing roll 7 hold the web 2 tightly against the backing roll 7, instead of, or in addition to, a nip roll or device 8 of FIG. 2. This embodiment has an abrasion roll 8, and calender rolls 4 and 5. The web 2 is moving in the direction of arrow 2*a*. Thus, calendering takes place after abrasion.

The mechanical softening process of the present invention obtains many benefits and improvements over the prior art. For example, single-side (air-side) abrasion reduces the two-sidedness of a single ply web and improves the strength/softness curve for uncreped bath tissue. The process works the outside surface layers of any given tissue web without significantly affecting the center layers. Two-sided abrasion significantly improves the strength/softness curve for uncreped bath tissue.

When uncreped through air dried tissues, such as those disclosed in the aforementioned patent and patent application, that were incorporated herein by reference, are mechanically softened by this process a new and useful tissue is obtained. These softened uncreped tissues have areas of fibers across their surface that are selectively loosened. These selectively loosened areas correspond to the raised or protruding areas of the uncreped through dried tissue. Thus, to obtain these selected areas of loose fiber ends, the abrasion nip gap is set to provide for abrasion of the raised surfaces of the sheet while not abrading the depressed areas.

Mechanical softening results in the number of loose fiber ends on the surface of the web being increased as summarized in the data set out in Table I. A greater number of long fiber ends on the surface of the sheet translates into a greater number of fuzzies and less two-sidedness the sheet.

TABLE I

| Sample No. | Gap (inches) | Web speed (fpm) | Abrasion ratio | Abrasion roll roughness (Ra) | PR/EL mean (mm/mm) | PR/EL std. Dev. (mm/mm) | % fields >2.0 PR/EL | % fields >1.0 PR/EL |
|---|---|---|---|---|---|---|---|---|
| 1 | — | — | n/a | n/a | 0.71 | 0.41 | 1 | 25 |
| 2 | 0.006 | 2200 | 1.5 | 250 | 2.44 | 0.85 | 67 | 95 |
| 3 | 0.006 | 1000 | 1.5 | 250 | 1.72 | 0.71 | 30 | 85 |
| 4 | 0.012 | 1000 | 1.5 | 125 | 1.53 | 0.66 | 26 | 81 |
| 5 | 0.012 | 1000 | 1.5 | 250 | 1.70 | 0.84 | 32 | 80 |
| 6 | 0.012 | 1000 | 1.5 | 250 (w/silicone) | 1.54 | 0.71 | 23 | 76 |
| 7 | 0.012 | 1000 | 1.5 | 400 | 1.61 | 0.68 | 29 | 82 |
| 8 | 0.012 | 1000 | 2.0 | 250 | 3.60 | 1.10 | 91 | 100 |
| 9 | 0.012 | 1000 | 2.0 | 250 | 3.71 | 1.12 | 94 | 100 |
| 10 | 0.012 | 1000 | 1.5 | 250 | 1.43 | 0.61 | 15 | 69 |
| 11 | 0.012 | 1500 | 1.5 | 250 | 1.44 | 0.76 | 21 | 67 |
| 12 | — | — | n/a | n/a | 0.09 | 0.07 | 0 | 0 |
| 13 | — | — | n/a | n/a | 0.51 | 0.33 | 0 | 7 |

In Table I, sample 1 was a control sample which was not abraded. The sheets for samples 1 to 11 were three layer sheets, of about a basis weight of 17 lbs/2880 $ft^2$ with the outside layers consisting primarily of hardwood and each layer being about 25% of the sheet, and the inside layer being primarily softwood and about 50% of the sheet. Sample 12 was a commercially available product Scottissue® (1000 count) and sample 13 was a commercially available tissue Charmin® Ultra (340 count). Samples 1, 12 and 13 were not abraded. The "Abrasion Ratio" was the abrasion roll speed over the backing roll speed. The PR/EL data was attained by using the following technique. A sample of the tissue was cut and folded along the machine direction. Along the edge of the fold, one hundred fields of view showing fibers that protrude from the surface of the sheet are then counted and their perimeter measured. The PR/EL value is the sum of the perimeters of the counted fibers divided by the length of edge over which they were counted. Specific counts or data points, showing the distribution of 100 samples by PR/EL ratio, that were taken for samples 1 to 13 in Table I are set forth in Table IA.

The PR/EL data was obtained using a Quantimet 900 Image analysis system, obtained from Leica (formally known as Cambridge Instruments) of Deerfield, Ill. The samples were draped over a spatula having a width of 3/32". This gave rise to a smooth, yet small radius of curvature over which the tissue was folded. The sample was then analyzed using the Quantimet 900 and the following software to determine the total circumference of the protruding fibers and the edge length of the tissue over which that total circumference was obtained. For example, referring to FIG. 20, the black area corresponds to the tissue that is folded over the spatula, the gray area to background and the white areas to the protruding fibers. Thus, the PR/EL is the accumulated perimeter of the white areas divided by the edge length (which as depicted in FIG. 20 would be the frame height of that figure). The following software written in Quips language was used on the Quantiment 900 to obtain the PR/EL set forth herein.

```
Cambridge Instruments QUANTIMET 900          QUIPS/MX : V03.02        USER    :
ROUTINE ; FLDFZ4
    DOES = Scans 100 fields on two strips, 2×20inches,
           to get PROEREL histograms on TISSUES.
    COND = Olymp Scope; 4× Obj; 1.5× on Iamge Amp; Low-mas condens;
           VNDF + fixed on glass; condens and field diaphragm = wide open;
           Nickel spatula taped onto Y-motion for edge exam;
           33-gram weight used to tension the tissues."
    Enter specimen identity
    Scanner        ( No. 2 Newvicon LV=4.82 SENS=1.50 )
    CALL STANDARD
    Load Shading Corrector ( pattern – FLDFUZ)
    Calibrate User Specified (Calibration Value = 3.019 microns          per pixel)
    TOTFIELDS          := 0.
    TOTPROVEL          := 0.
    For SAMPLE = 1 TO        2
    STAGEX             := 5000.
    STAGEY             := 80000.
    Stage Move ( STAGEX,STAGEY)
    Stage Scan       (                      X            Y
                       scan origin     5000.0       80000.0
                       field size      1500.0       3000.0
                       no of fields      50            1    )
    Pause Message
    PLEASE POSITION THE NEXT SAMPLE
    Pause
    Detect 2D        ( Darker than 35 and Lighter than 10 PAUSE )
    For FIELD
    Image Frame is Standard Live Frame
    Live Frame is Standard Image Frame
    Detect 2D        ( Darker than 35 and Lighter than 10 )
    Amend              ( OPEN by 1 – Horizontally )
    Amend              ( OPEN by 1 – Vertically )
    Measure field - Parameters into array FIELD
    PROVEREL       := FIELD PERIMETER / 1886.9
    Distribute COUNT vs PROVEREL into GRAPH
        from       0.00 to        8.00 into 40 bins, differential
    TOTPROVEL      := TOTPROVEL + PROVEREL
    TOTFIELDS      := TOTFIELDS + 1.
    Stage Step
    Next FIELD
    Next
    STAGEX         := 5000.
    STAGEY         := 80000.
    Stage Move ( STAGEX,STAGEY)
    Print " "
    Print " "
    Print Distribution ( GRAPH, differential, bar chart, scale = 0.00 )
    Print " "
    Print " "
    Print "AVE PR/EL =" , TOTPROVEL / TOTFIELDS , "FOR" , TOTFIELDS , "TO
        TAL FIELDS"
    Print " "
    Print " "
    For LOOPCOUNT = 1 to          5
    Print " "
    Next
    End of Program
```

TABLE 1A

| Limits PR/EL | Field Distributions Based on PR/EL SAMPLE NO. | | | | | | | | | | | | |
|---|---|---|---|---|---|---|---|---|---|---|---|---|---|
| (mm/mm) | 1 | 2 | 3 | 4 | 5 | 6 | 7 | 8 | 9 | 10 | 11 | 12 | 13 |
| 0.00–0.20 | 3 | | 1 | 1 | | | 1 | | | | 3 | 88 | 17 |
| 0.20–0.40 | 26 | | 3 | 2 | 1 | 2 | 1 | | | 1 | 1 | 11 | 29 |
| 0.04–0.06 | 21 | | | 2 | 4 | 3 | 5 | | | 5 | 9 | 1 | 24 |
| 0.06–0.08 | 11 | 3 | 5 | 8 | 8 | 6 | 3 | | | 11 | 9 | | 14 |
| 0.08–1.00 | 14 | 2 | 6 | 6 | 7 | 13 | 8 | | | 13 | 11 | | 9 |
| 1.00–1.20 | 14 | 1 | 8 | 13 | 13 | 13 | 9 | | | 9 | 13 | | 3 |
| 1.20–1.40 | 5 | 2 | 9 | 17 | 8 | 9 | 13 | 1 | 2 | 12 | 9 | | 1 |
| 1.40–1.60 | 3 | 5 | 15 | 10 | 11 | 14 | 13 | 1 | | 6 | 5 | | 2 |
| 1.60–1.80 | 1 | 10 | 10 | 11 | 9 | 10 | 12 | 1 | | 15 | 7 | | 1 |
| 1.80–2.00 | 1 | 10 | 13 | 4 | 7 | 7 | 6 | 6 | 4 | 13 | 12 | | |
| 2.00–2.20 | 1 | 10 | 8 | 13 | 7 | 5 | 9 | 1 | 2 | 4 | 9 | | |
| 2.20–2.40 | | 12 | 5 | 3 | 6 | 6 | 6 | 4 | 1 | 3 | 4 | | |
| 2.40–2.60 | | 4 | 3 | 2 | 5 | 6 | 5 | 8 | 4 | 4 | 3 | | |
| 2.60–2.80 | | 8 | 7 | 5 | 4 | | 6 | 8 | 10 | 3 | 1 | | |
| 2.80–3.00 | | 9 | 2 | 1 | 4 | 1 | 1 | 7 | 3 | | 1 | | |
| 3.00–3.20 | | 6 | 2 | 1 | | 1 | | 3 | 8 | | | | |
| 3.20–3.40 | | 4 | 2 | | 1 | 1 | 1 | 6 | 9 | 1 | | | |
| 3.40–3.60 | | 4 | 1 | | 1 | 3 | | 4 | 3 | | 2 | | |
| 3.60–3.80 | | 3 | | 1 | 1 | | 1 | 10 | 10 | | | | |
| 3.80–4.00 | | 3 | | | 2 | | | 8 | 4 | | | | |
| 4.00–4.20 | | | | | | | | 6 | 11 | | 1 | | |
| 4.20–4.40 | | 3 | | | 1 | | | 7 | 5 | | | | |
| 4.40–4.60 | | 1 | | | | | | 4 | 7 | | | | |
| 4.60–4.80 | | | | | | | | 1 | 5 | | | | |
| 4.80–5.00 | | | | | | | | 4 | 2 | | | | |
| 5.00–5.20 | | | | | | | | 3 | 2 | | | | |
| 5.20–5.40 | | | | | | | | 1 | 1 | | | | |
| 5.40–5.60 | | | | | | | | 2 | | | | | |
| 5.60–5.80 | | | | | | | | 3 | 1 | | | | |
| 5.80–6.00 | | | | | | | | | 2 | | | | |
| 6.00–6.20 | | | | | | | | | | | | | |
| 6.20–6.40 | | | | | | | | | | | | | |
| 6.40–6.60 | | | | | | | | | 2 | | | | |
| 6.60–6.80 | | | | | | | | | 1 | | | | |
| 6.80–7.00 | | | | | | | | | 1 | | | | |
| 7.00–7.20 | | | | | | | | | | | | | |
| 7.20–7.40 | | | | | | | | 1 | | | | | |
| 7.40–7.60 | | | | | | | | | | | | | |
| Total Counted | 100 | 100 | 100 | 100 | 100 | 100 | 100 | 100 | 100 | 100 | 100 | 100 | 100 |

The mechanical softening process of the present invention, although applicable to any type of fibers, has varying results and affects with different types and mixes of fibers. For example, as the level of softwoods are increased in the outside layers, the amount of dust generated by the process is reduced.

Similarly, the process reduced the basis weight of blended and 100% long fiber monolayer sheets to a lesser degree than layered fiber sheets. Although it is believed that most of the basis weight reduction occurred during the winding and calendering process. If abrasion is done on the machine, the losses associated with the separate winding, unwinding or rewinding should not occur.

The extent to which the process may reduce the caliper of the sheet however, does not appear to vary with different fiber types. While it is believed that most of the caliper reduction can be attributed to calendering and the winding process, caliper reduction can occur from abrading one side of the sheet (air side of the sheet). When abraded the second time to the fabric side of the sheet, the process does not significantly decrease the caliper and in some cases may actually increase the caliper versus the one side abrasion process, even after having to run through a second winding process for two side abrasion.

Fiber type does have an effect of the amount of the MD-strength loss that may occur from the process. This strength loss primarily occurs from the calendering and winding process, with a minimal loss occurring from abrading the sheet. Although a more significant loss in MD-strength occurred when abraded a second time, which however, included an additional winding process. The process produced a minimal loss in MD-strength for 66% hardwood—34% softwood layered and blended sheets, but indicated a greater loss in MD-strength for 100% softwood fiber sheets. It is theorized that this occurred because the 100% softwood fiber sheet's strength is accounted for in the outside layers as well as the center layer versus a layered sheet, which has its strength predominantly located in the center layer, with very little strength of the sheet coming from the hardwood fibers located in the outside layers of the sheet. The theory being, that because the process works the outside surfaces or the outside layers of the sheet, the process is breaking the bonds of the fibers located in the outside layers of the sheet.

Similarly, fiber type and sheet composition may have an effect on CD-strength. The process may produce a minimal loss in CD-strength for 66% hardwood—34% softwood layered and the blended sheets. A greater loss in CD-strength for the 100% softwood fiber sheets occurred.

A loss of MD-stretch can occur, but most of the losses can be attributed to the winding and calendering process. No significant loss in CD-stretch occurs from the process.

Figure 6:
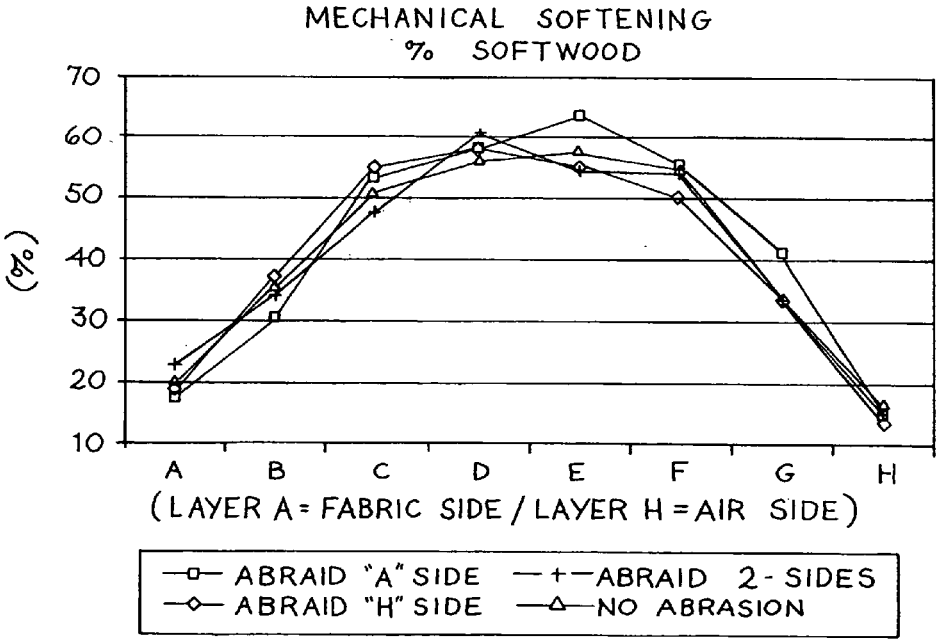
FIG. 6 is a graph charting data.
Figure 7:
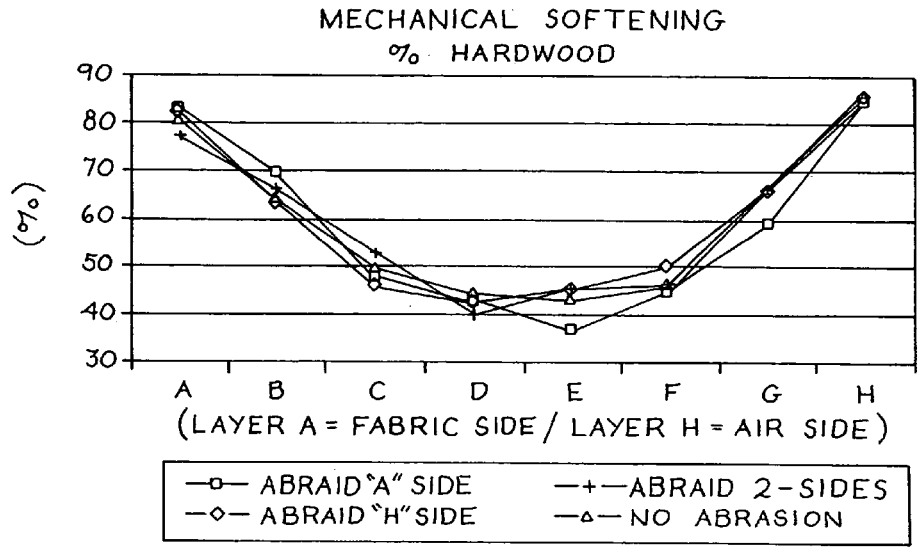
FIG. 7 is a graph charting data.

The process may generate a larger amount of dust when the outside layers of the sheet consist of mostly shorter hardwood fibers. However, based on the data from an 8-Layer Purity test on the layered sheet, the total fiber loss between an abraded or non-abraded sheet was not significant as shown in the data set out in Table II and III below and charted in FIGS. 6 and 7.

TABLE II

| Sample | Layer | Abraded "A" Side (fabric side) % softwood | Abraded 2-Sides % softwood | Abraded "H" Side (air side) % softwood | No Abrasion % softwood |
|---|---|---|---|---|---|
| 1 | A | 17.3 | 23.0 | 18.3 | 19.9 |
| 2 | B | 30.4 | 34.2 | 36.7 | 35.6 |
| 3 | C | 53.3 | 47.5 | 54.5 | 50.6 |
| 4 | D | 57.7 | 60.2 | 57.2 | 56.1 |
| 5 | E | 63.1 | 54.3 | 54.9 | 56.9 |
| 6 | F | 55.2 | 53.8 | 50 | 54.5 |
| 7 | G | 40.9 | 33.2 | 33.9 | 33.9 |
| 8 | H | 14.4 | 14.0 | 13.6 | 15.5 |

TABLE III

| Sample | Layer | Abraded "A" Side (fabricide) % Hardwood | Abraded 2-Sides % Hardwood | Abraded "H" Side (air side) % Hardwood | No Abrasion % Hardwood |
|---|---|---|---|---|---|
| 1 | A | 82.7 | 77.0 | 81.7 | 80.1 |
| 2 | B | 69.6 | 65.8 | 63.3 | 64.4 |
| 3 | C | 46.7 | 52.5 | 45.6 | 49.4 |
| 4 | D | 42.3 | 39.8 | 42.8 | 43.9 |
| 5 | E | 36.9 | 45.8 | 45.1 | 43.1 |
| 6 | F | 44.8 | 46.2 | 50 | 45.5 |
| 7 | G | 59.1 | 66.8 | 66.1 | 66.1 |
| 8 | H | 85.6 | 86.1 | 86.4 | 84.5 |

The data from the fiber analysis of the dust generated, indicated that over 95% of all the dust consisted of short hardwood fibers. When the outside layer consisted of longer softwood fibers, the dust generation was significantly less. It is theorized that this phenomena may be explained by bond area as it relates to fiber length and the amount of free fibers. Long fibers have more bond area and the abrasion process tends to produce loose fiber ends, while the other end, as well as at times the center, of the fiber was still embedded in the web, thus, creating a fuzzy surface. The sheet which seemed to produce the least amount of dust tended to be the 100% NB 50 (soft wood spruce pulp) fiber sheet. Of the sheets comprised of long and short fibers, the sheet with the undispersed Eucalyptus (hardwood, short fibers) seemed to produce the least amount of dust. Methods and apparatus for handling and controlling dust are well known to those skilled in the art and if needed for a particular application may be used.

Figure 8:
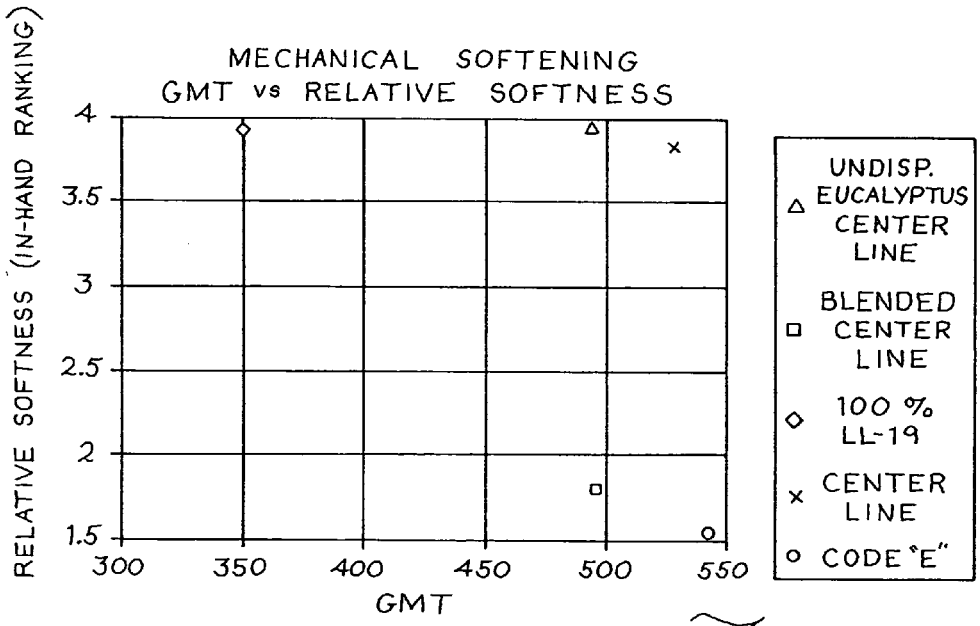
FIG. 8 is a graph charting data.
Figure 9:
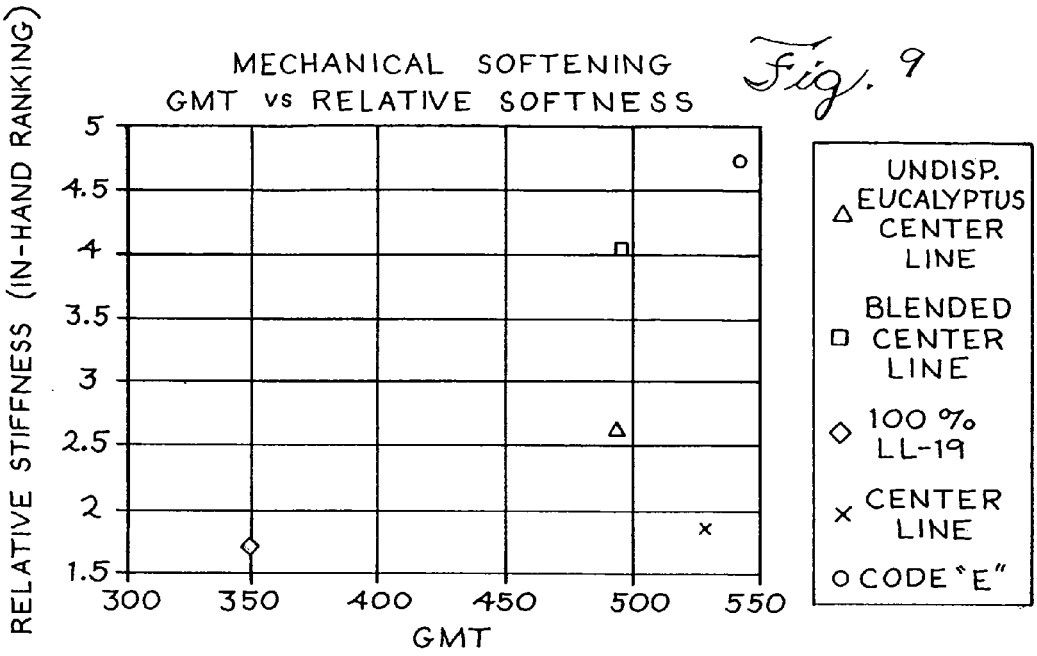
FIG. 9 is a graph charting data.
Figure 10:
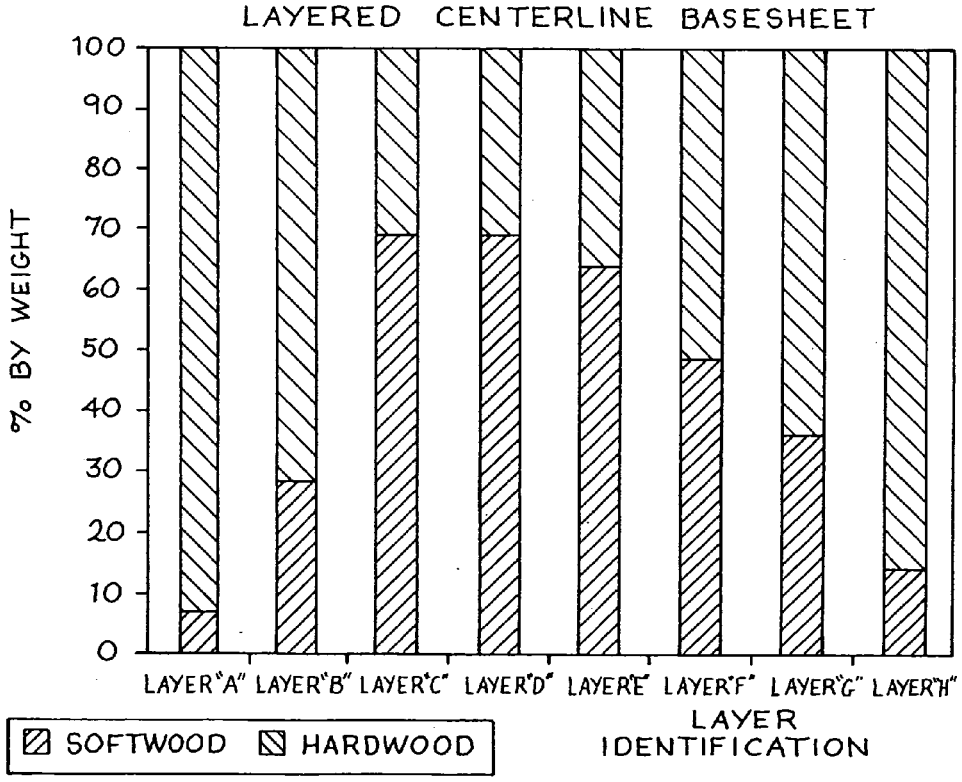
FIG. 10 is a graph charting data.

The process tends to improve layered sheets more than blended sheets with respect to softness and stiffness versus strength and caliper loss as shown in the data in Tables IV and V and as charted in FIGS. 8 and 9 respectively. (In FIGS. 8 and 9, Code "E" is calendered only layered centerline sheet. Centerline sheet as used herein is about 17 lbs/2880 $ft^2$, 3 layered sheet, with the outside layers consisting primarily of hardwood and each layer being about 25% of the sheet, and the inside layer being primarily softwood and about 50% of the sheet.) All other conditions are calendered sheets as specified to meet caliper specifications and abraded on both sides of the sheet. A similar loss in GMT with a blended versus a layered sheet can also be seen. However, when compared using a softness panel in-hand ranking, the layered sheets strength softness curve was improved compared to the uncreped through air dried calendered only (Code "E") and blended sheet relative to both softness and stiffness. 8-layer purity test data for both the layered centerline and blended sheets are shown in Tables VI and VII and charted in FIGS. 10 and 11 respectively.

TABLE IV (GMT vs. Relative Softness)

| Base Sheet | Inhand Ranking Softness | GMT |
|---|---|---|
| Undispersed Eucalyptus | 3.916667 | 493.9682 |
| Blended Centerline | 1.791667 | 496.2988 |
| 100% LL-19 | 3.916667 | 350.0505 |
| Center line | 3.83333 | 528.0589 |
| Code E (Calendered Only) | 1.641667 | 542.3283 |

TABLE V (GMT vs. Relative Stiffness)

| Base Sheet | Inhand Ranking Stiffness | GMT |
|---|---|---|
| Undispersed Eucalyptus | 2.625 | 493.9682 |
| Blended Centerline | 4.041667 | 496.2988 |
| 100% LL-19 | 1.708333 | 350.0505 |
| Center line | 1.875 | 528.0589 |
| Code E (Calendered Only) | 4.75 | 542.3283 |

TABLE VI

| | Softwood | | | | Hardwood | | | |
|---|---|---|---|---|---|---|---|---|
| Layer | Raw Count | Weight Factor | Final Count | % By Weight | Raw Count | Weight Factor | Final Count | % By Weight |
| Layer "A" | 52 | 0.9 | 47 | 6.8 | 1828 | 0.35 | 640 | 93.2 |
| Layer "B" | 162 | 0.9 | 146 | 28.2 | 1059 | 0.35 | 371 | 71.8 |

TABLE VI-continued

| Layer | Softwood Raw Count | Softwood Weight Factor | Softwood Final Count | Softwood % By Weight | Hardwood Raw Count | Hardwood Weight Factor | Hardwood Final Count | Hardwood % By Weight |
|---|---|---|---|---|---|---|---|---|
| Layer "C" | 386 | 0.9 | 347 | 69 | 447 | 0.35 | 156 | 31 |
| Layer "D" | 414 | 0.9 | 373 | 63.7 | 486 | 0.35 | 170 | 31.3 |
| Layer "E" | 310 | 0.9 | 279 | 63.7 | 455 | 0.35 | 159 | 36.3 |
| Layer "F" | 169 | 0.9 | 152 | 48.7 | 457 | 0.35 | 160 | 51.3 |
| Layer "G" | 187 | 0.9 | 168 | 36.3 | 844 | 0.35 | 295 | 63.7 |
| Layer "H" | 96 | 0.9 | 86 | 14.5 | 1451 | 0.35 | 508 | 85.5 |

TABLE VII

| Layer | Softwood Raw Count | Softwood Weight Factor | Softwood Final Count | Softwood % By Weight | Hardwood Raw Count | Hardwood Weight Factor | Hardwood Final Count | Hardwood % By Weight |
|---|---|---|---|---|---|---|---|---|
| Layer "A" | 320 | 0.9 | 288 | 46.7 | 940 | 0.35 | 329 | 53.3 |
| Layer "B" | 196 | 0.9 | 176 | 45.1 | 611 | 0.35 | 214 | 54.9 |
| Layer "C" | 187 | 0.9 | 168 | 47.9 | 522 | 0.35 | 183 | 52.1 |
| Layer "D" | 228 | 0.9 | 205 | 45 | 716 | 0.35 | 251 | 55 |
| Layer "E" | 237 | 0.9 | 213 | 39.7 | 923 | 0.35 | 323 | 60.3 |
| Layer "F" | 215 | 0.9 | 194 | 46.4 | 640 | 0.35 | 224 | 53.6 |
| Layer "G" | 277 | 0.9 | 249 | 46.9 | 805 | 0.35 | 282 | 53.1 |
| Layer "H" | 433 | 0.9 | 390 | 49.6 | 1134 | 0.35 | 397 | 50.4 |

The mechanical softening process tended to work the outside surfaces of a given sheet and had some to little effect on the center of the sheet depending upon the type of sheet used. The process improves the softness and stiffness of the 100% long fiber sheet but affected the strengths of those sheets. It is theorized that the layered or blended long fiber and short fiber sheets are structured so that the long fibers make up the largest portion of the strength of the sheet, and the short fibers are used to improve softness. As such, any sheet comprised of equally treated, 100% long fibers has the strength evenly divided throughout the layers of the sheet. Consequently, when a process such as mechanical softening works the outside layers of a sheet, it more significantly reduces the strength of that sheet as shown in the data set out in Table IV and V and charted in FIGS. 8 and 9.

The strength/softness curve for mechanically softened sheets shows that these sheets are at a point located above the strength/softness curve for a sheet that is only calendered. When abraded on the air side of the sheet only, such sheet is at a point above the strength/softness curve. When the sheets are abraded on both sides of the sheet, such sheet is at a point above the strength/softness curve for a calendered only sheet. These results are set forth in the data set out in Tables IV and V charted in FIGS. 8, 9, and 12. As used herein the term "GMT" is equal to the square root of the sum of the MD-strength multiplied by the CD-strength.

Generally between a 4 to 7% reduction in the basis weight occurs with calendering only. An additional 2 to 3% reduction in basis weight occurs from calendering and 1-side abrasion. Because the process on a pilot plant as configured, was only capable of abrading one side of the sheet at a time, the roll was converted as a one-side abraded roll and wound up on the reel. It was then removed and replaced on the unwinder and run though the converting process and abraded a second time. Because the product goes through the winder a second time, it is theorized that the sheet will lose a certain percent of basis weight, caliper, stretch and strength due strictly from the winding process itself. These losses should not occur in a commercial process either where the sheet is abraded off-machine or where the sheet is abraded on the machine, either single side or both sides. Hence, when the sheet is abraded a second time to the fabric side of the sheet, the sheet experiences, on the pilot plant, an additional 1 to 4% reduction in basis weight for the blended and 100% long fiber sheets, while the layered sheets experienced an additional 4 to 6% reduction of basis weight. In commercial applications two sided abrasion could be conducted simultaneously thereby eliminating the second rewinding step.

Figure 13:
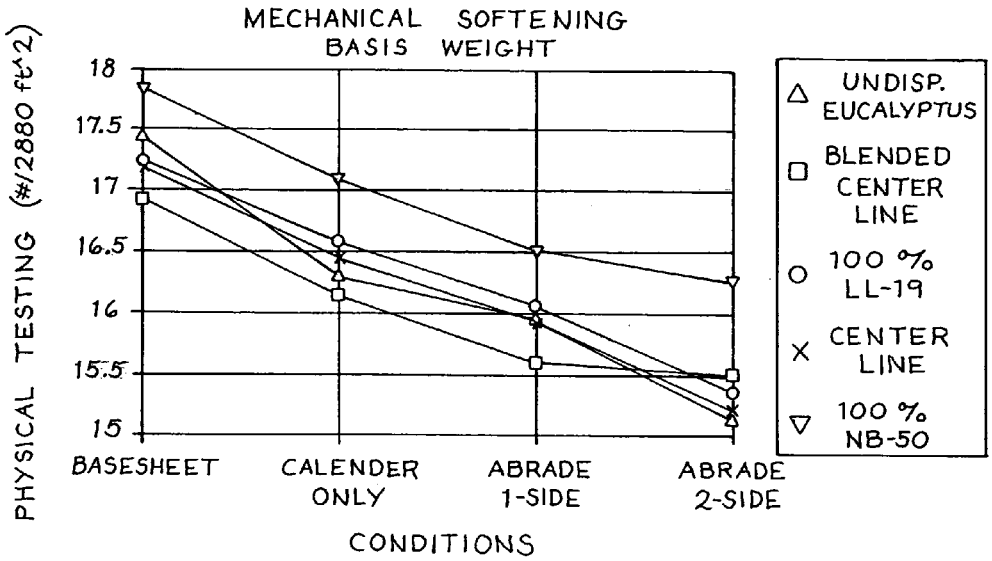
FIG. 13 is a graph charting data.

Changes in basis weight for particular types of sheets are as follows, and are also set forth in the data set out in Table VIII and charted in FIG. 13.

TABLE VIII

Basis Weight Comparison (#/2880 $ft^2$)

| Basesheet Type | Basis Weight: Basesheet | Basis Weight: Calendered Only | Basis Weight: Abrade 1-Side | Basis Weight: Abrade 2-Side |
|---|---|---|---|---|
| Undisp. Eucalyptus | 17.46 | 16.3 | 15.95 | 15.15 |
| Blended | 16.92 | 16.13 | 15.59 | 15.51 |
| 100% LL-19 | 17.24 | 16.56 | 16.06 | 15.38 |
| Centerline | 17.18 | 16.45 | 15.92 | 15.22 |
| 100% NB-50 | 17.84 | 17.07 | 16.5 | 16.28 |

Undispersed Eucalyptus Layered Sheet—The data indicates a 6.6% reduction in basis weight with calendering (17.46 #/2880 $ft^2$ to 16.3 #/2880 $ft^2$) and an additional 2.1% from calendering and 1-side abrasion (16.3 #/2880 $ft^2$ to 15.95 #/2880 $ft^2$) with an additional 5.0% reduction from 2-side abrasion and the second winding process (15.95 #/2880 $ft^2$ to 15.15 #/2880 $ft^2$), for a total of a 13.2% reduction in basis weight from sheet to 2-sided abrasion (17.46 #/2880 $ft^2$ to 15.15 #/2880 $ft^2$).

Blended Fiber Sheet—The data indicates a 4.7% reduction in basis weight with calendering (16.92 #/2880 $ft^2$ to 16.13 #/2880 $ft^2$) and an additional 3.3% from calendering and 1-side abrasion (16.13 #/2880 $ft^2$ to 15.59 #/2880 $ft^2$) with an additional a 0.5% reduction from 2-side abrasion and the second winding process (15.59 #/2880 $ft^2$ to 15.51 #/2880 $ft^2$), for a total of a 8.3% reduction in basis weight from sheet to 2-sided abrasion (16.92 #/2880 $ft^2$ to 15.51 #/2880 $ft^2$).

100% (long fiber) LL 19 Sheet—The data indicates a 3.9% reduction in basis weight with calendering (17.24 #/2880 $ft^2$ to 16.56 #/2880 $ft^2$) and an additional 3.0% from calendering and 1-side abrasion (16.56 #/2880 $ft^2$ to 16.06 #/2880 $ft^2$) with an additional a 4.2% reduction from 2-side abrasion and the second winding process (16.06 #/2880 $ft^2$ to 15.38 #/2880 $ft^2$), for a total of 10.8% reduction in basis weight from sheet to 2-sided abrasion (17.24 #/2880 $ft^2$ to 15.38 #/2880 $ft^2$).

Layered Fiber Centerline Sheet—The data indicates a 4.2% reduction in basis weight with calendering (17.18 #/2880 $ft^2$ to 16.45#2880 $ft^2$) and an additional 3.2% from calendering and 1-side abrasion (16.45 #/2880 $ft^2$ to 15.92 #/2880 $ft^2$) with an additional a 4.4% reduction from 2-side abrasion and the second winding process (15.92 #/2880 $ft^2$ to 15.22 #/2880 $ft^2$), for a total of a 11.4% reduction in basis weight from sheet to 2-sided abrasion (17.18 #/2880 ft ˆ2 to 15.22 #/2880 $ft^2$).

100% (long fiber) NB50 Sheet—The data indicates a 4.3% reduction in basis weight with calendering (17.84 #/2880 $ft^2$ to 17.07 #/2880 $ft^2$) and an additional 3.3% from calendering and 1-side abrasion (17.07 #/2880 $ft^2$ to 16.5 #/2880 $ft^2$) with an additional a 1.3% reduction from 2-side abrasion and the second winding process (16.5 #/2880 $ft^2$ to 16.28 #/2880 $ft^2$), for a total of a 8.7% reduction in basis weight from sheet to 2-sided abrasion (17.84 #/2880 $ft^2$ to 16.28 #/2880 $ft^2$).

Between a 33 to 44% reduction in the caliper occurs with calendering only. An additional 12 to 21% reduction in caliper occurs from calendering and 1-side abrasion. Because the process on the pilot plant as configured, was only capable of abrading one side of the sheet at a time, the roll was converted as a one-side abraded roll and would up on the reel. It was then removed and replaced on the unwind and run though the converting process and abraded a second time. Because the product goes through the winder a second time, it is theorized that the sheet will lose a certain percent of basis weight, caliper, strength and stretch due strictly from the winding process itself. Hence, when the sheet was abraded a second time to the fabric side of the sheet, the sheet experienced an additional 0.2 to 0.7% reduction in caliper. In commercial applications two sided abrasion could be conducted simultaneously and either off-machine or on the machine, thereby eliminating one or both of the rewinding steps.

Figure 14:
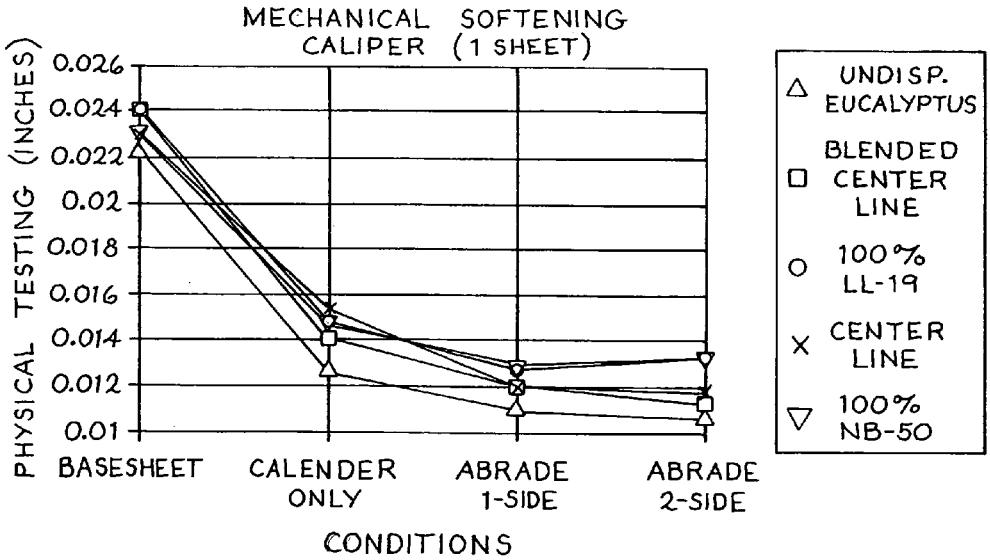
FIG. 14 is a graph charting data.

Changes in caliper for particular types of sheets are as follows, and are also set forth in FIG. 14.

Undispersed Eucalyptus Layered Sheet—The data indicates a 43.8% reduction in caliper with calendering (0.0224 inches to 0.0126 inches) and an additional 13.5% from calendering and 1-side abrasion (0.0126 inches to 0.0109 inches) with an additional a 2.8% reduction from 2-side abrasion and the second winding process (0.109 inches to 0.0106 inches). Through the entire process from sheet to a final produced calendered and two-sided abrasion, the sheet saw a 52.7% reduction in caliper (0.0224 inches to 0.0106 inches).

Blended Fiber Sheet—The data indicates a 41.5% reduction in caliper with calendering only (0.0241 inches to 0.0141 inches) and an additional 14.9% from calendering and 1-side abrasion (0.0141 inches to 0.012 inches) with an additional a 6.7% reduction from 2-side abrasion and the second winding process (0.012 inches to 0.0112 inches). Through the entire process from sheet to a final produced calendered and two-sided abrasion, the sheet saw a 53.5% reduction in caliper (0.0241 inches to 0.0112 inches).

100% (long fiber) LL19 Sheet—The data indicates a 38.4% reduction in caliper with calendering (0.242 inches to 0.0149 inches) and an additional 14.8% from calendering and 1-side abrasion (0.0149 inches to 0.0127 inches) with an additional a 3.8% increase from 2-side abrasion and the second winding process (0.0127 inches to 0.0132 inches). Through the entire process from the sheet to a final produced calendered and two-sided abrasion, the sheet saw a 45.5% reduction in caliper (0.0242 inches to 0.0132 inches).

Layered Fiber Centerline Sheet—The data indicates a 33.3% reduction in caliper with calendering (0.0231 inches to 0.0154 inches) and an additional 21.4% from calendering (0.154 inches to 0.0121 inches) and 1-side abrasion with an additional a 4.1% reduction from 2-side abrasion and the second winding process (0.0121 inches to 0.0116 inches). Through the entire process from sheet to a final produced calendered and two-sided abrasion, the sheet saw a 49.8% reduction in caliper (0.0231 inches to 0.0116 inches).

100% (long fiber) NB50 Sheet—The data indicates a 36.1% reduction in caliper with calendering (0.023 inches to 0.0147 inches) and an additional 12.2% from calendering and 1-side abrasion (0.0147 inches to 0.0129 inches) with an additional a 2.3% increase from 2-side abrasion and the second winding process (0.0129 inches to 0.0132 inches). Through the entire process from sheet to a final produced calendered and two-sided abrasion, the sheet saw a 42.6% reduction in caliper (0.023 inches to 0.0132 inches).

Between a 5.2 and 15.5% reduction in the MD-strength occurs with calendering only. An additional 0.4 to 9.4% reduction in MD-strength occurs from calendering and 1-side abrasion. Because the process on the pilot plant as configured, was only capable of abrading one side of the sheet a time, the roll was converted as a one-side abraded roll and would up on the reel. It was then removed and replaced on the unwind and run though the converting process and abraded a second time. Because the product goes through the winder a second time, it is theorized that the sheet will lose a certain percent of basis weight, caliper, strength and stretch due strictly from the winding process itself. Hence, when the sheet was abraded a second time to the fabric side of the sheet, the sheet experienced an additional 1.7 to 6.6% reduction in MD-strength for the layered fiber sheets and the blended fiber sheets and an additional 16.3 to 19.9% reduction in MD-strength for the 100% long fiber sheets. In commercial applications two sided abrading could be conducted simultaneously either off-machine or on the machine, thereby eliminating one or both of the rewinding steps.

Figure 16:
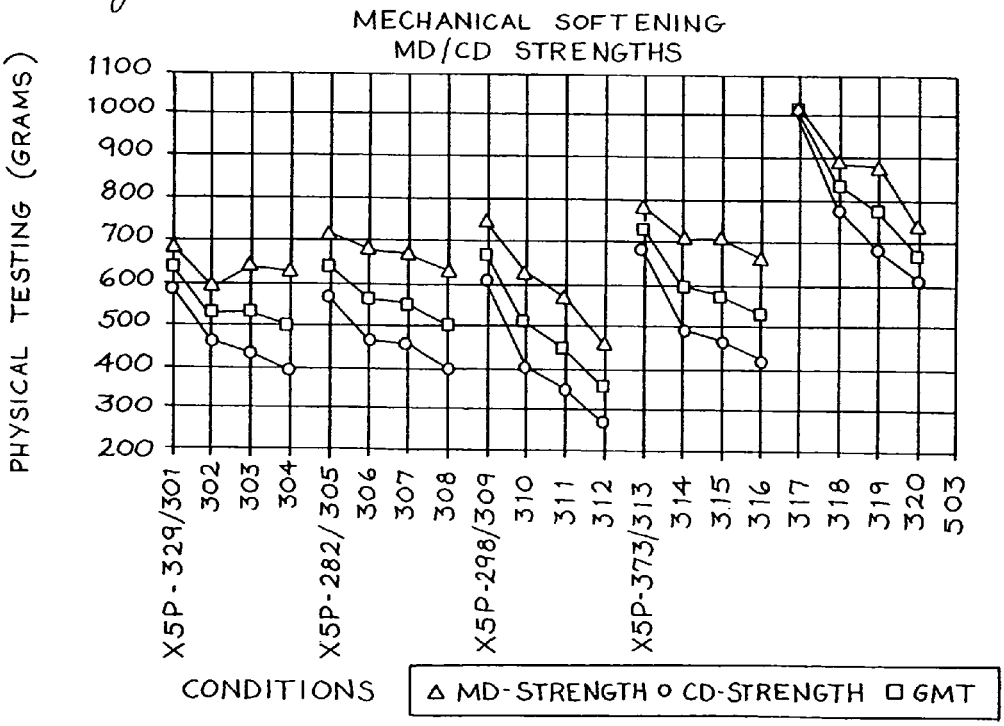
FIG. 16 is a graph charting data.

Changes in MD-strength for particular types of sheets are as follows, and are also set forth in the data set out in Table IX and charted in FIG. 16.

TABLE IX

| Base Sheet Type | Code # | MD Strength | CD Strength | GMT |
|---|---|---|---|---|
| Undisp. Eucalyptus | | | | |
| Base Sheet | 301 | 682.7 | 580.5 | 629.5 |
| Calender Only | 302 | 588.0 | 462.3 | 521.4 |
| Abrade 1-Side | 303 | 638.2 | 431.0 | 524.5 |
| Abrade 2-Side | 304 | 627.1 | 389.1 | 494.0 |
| Blended | | | | |
| | 305 | 714.7 | 563.1 | 634.4 |
| | 306 | 677.7 | 461.7 | 559.4 |
| | 307 | 666.2 | 452.0 | 548.7 |
| | 308 | 625.0 | 394.1 | 496.3 |
| 100% LL-19 | | | | |
| | 309 | 743.7 | 599.5 | 667.7 |
| | 310 | 628.3 | 403.2 | 503.3 |
| | 311 | 569.5 | 351.3 | 447.3 |
| | 312 | 456.2 | 268.6 | 350.1 |
| Centerline | | | | |
| | 313 | 782.5 | 683.0 | 731.1 |
| | 314 | 711.0 | 491.8 | 591.3 |
| | 315 | 707.9 | 466.7 | 574.9 |
| | 316 | 661.4 | 421.6 | 528.1 |
| 100% NB-50 | | | | |
| | 317 | 1025.2 | 1005.4 | 1014.3 |
| | 318 | 888.8 | 778.9 | 832.0 |
| | 319 | 881.8 | 681.0 | 774.9 |
| | 320 | 737.8 | 611.1 | 671.5 |

Undispersed Eucalyptus Layered Sheet—The data indicates a 13.9% reduction in MD-strength with calendering (682.7 grams to 588 grams). The MD-strength is less after calendering than after one-sided abrasion (588 grams to 638.2 grams). (But, this data may be reflecting variations in the base sheet.) The data did indicate an additional a 1.7% reduction from 2-side abrasion and the second winding process (638.2 grams of 627.1 grams). Through the entire process from sheet to a final produced calendered and two-sided abrasion, the sheet saw a 8.1% reduction in MD-strength (682.7 grams to 627.1 grams).

Blended Fiber Sheet—The data indicates a 5.2% reduction in MD-strength with calendering (714.7 grams to 677.7 grams) and an additional 1.7% from calendering and 1-side abrasion (677.7 grams to 666.2 grams) with an additional 6.2% reduction from 2-side abrasion and the second winding process (666.2 grams to 625 grams). Through the entire process from sheet to a final produced calendered and two-sided abrasion, the sheet saw a 12.6% reduction in MD-strength (714.7 grams to 625 grams).

100% (long fiber) LL19 Sheet—The data indicates a 15.5% reduction in MD-strength with calendering (743.7 grams to 628.3 grams) and an additional 9.4% from calendering and 1-side abrasion (628.3 grams to 569.5 grams) with an additional a 19.9% decrease from 2-side abrasion and the second winding process (569.3 grams to 456.2 grams). Through the entire process from sheet to a final produced calendered and two-sided abrasion, the sheet saw a 38.7% reduction in MD-strength (743.7 grams to 456.2 grams).

Layered Fiber Centerline Sheet—The data indicates a 9.1% reduction in MD-strength with calendering (782.5 grams to 711 grams) and an additional 0.4% from calendering and 1-side abrasion (711 grams to 707.9 grams) with an additional a 6.6% reduction from 2-side abrasion and the second winding process (707.9 grams to 661.4 grams). Through the entire process from sheet to a final produced calendered and two-sided abrasion, the sheet saw a 15.5% reduction in MD-strength (782.5 grams to 661.4 grams).

100% (long fiber) NB50 Sheet—The data indicates a 13.1% reduction in MD-strength with calendering (1023.2 grams to 888.8 grams) and an additional 0.8% from calendering and a 1-side abrasion (888.8 grams to 881.8 grams) with an additional a 16.3% reduction from 2-side abrasion and the second winding process (881.8 grams to 737.8 grams). Through the entire process from sheet to a final produced calendered and two-sided abrasion, the sheet saw a 27.9% reduction in MD-strength (1023.2 grams to 737.8 grams).

Between an 18 to 28% reduction in the CD-strength occurred with calendering only. An additional 2.1 to 12.9% reduction in CD-strength occurs from calendering and 1-side abrasion. Because the process on the pilot plant as configured, was only capable of abrading one side of the sheet at a time, the roll was converted as a one-side abraded roll and wound up on the reel. It was then removed and replaced on the unwind and run though the converting process and abraded a second time. Because the product goes through the winder a second time, it is theorized that the sheet will lose a certain percent of basis weight, caliper and stretch due strictly from the winding process itself. Hence, when the sheet was abraded a second time to the fabric side of the sheet, the sheet experienced an additional 9.7% reduction in CD-strength for the layered fiber sheets and an additional 10.3 to 23.5% reduction in CD-strength for the 100% long fiber and blended fiber sheets. In commercial applications two sided abrading could be conducted simultaneously either off-machine or on the machine, thereby eliminating one or both of the rewinding steps.

Figure 15:
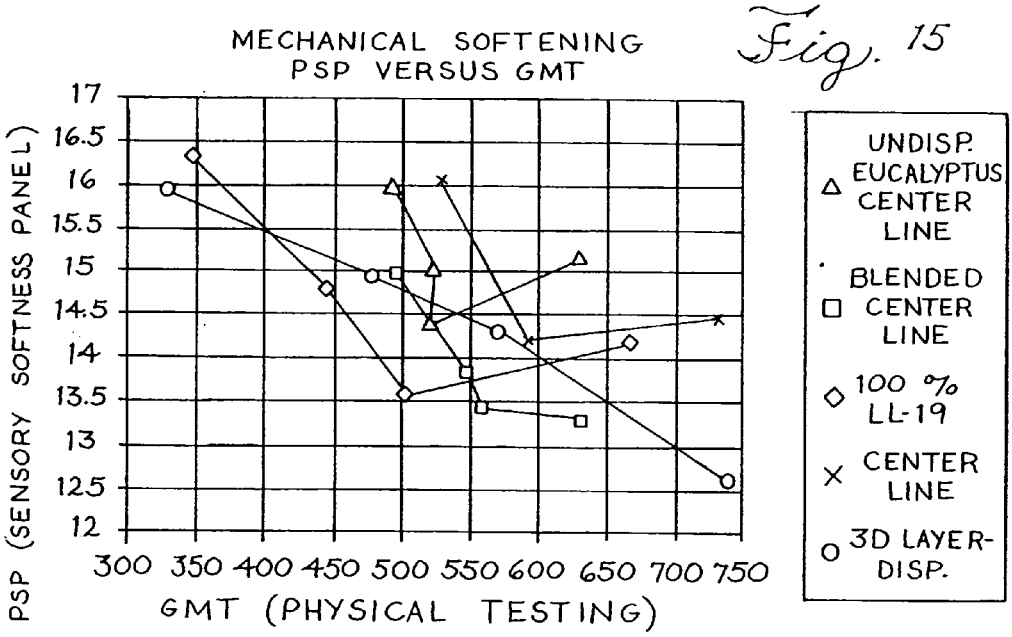
FIG. 15 is a graph charting data.

Changes in CD-strength for particular types of sheets are as follows, and are also set forth in the data set out in Table IX and charted in FIG. 16. Table X sets out data relating to softness and changes in strength and is charted in FIG. 15.

TABLE X

| PSP versus GMT | | |
|---|---|---|
| Base Sheet Type | PSP | GMT |
| Undispersed Eucalyptus | | |
| Basesheet | 15.13 | 628.6 |
| Calender Only | 14.35 | 521.4 |
| Abrade 1-Side | 15.02 | 524.5 |
| Abrade 2-Side | 16.00 | 494.0 |
| Blended | 13.29 | 634.4 |
| | 13.41 | 559.4 |
| | 13.80 | 548.7 |
| | 14.94 | 496.3 |

TABLE X-continued

| PSP versus GMT | | |
|---|---|---|
| Base Sheet Type | PSP | GMT |
| 100% LL-19 | 14.13 | 667.7 |
| | 13.54 | 503.3 |
| | 14.74 | 447.3 |
| | 16.33 | 350.1 |
| Centerline | 14.42 | 731.1 |
| | 14.18 | 591.3 |
| | 14.71 | 574.8 |
| | 16.07 | 528.1 |
| 3 Layer-Dispersed | 12.60 | 739.4 |
| (HW Dispersed outer layers) | 14.26 | 573.0 |
| | 14.90 | 482.8 |
| | 15.92 | 330.3 |

PSP is a softness determination that is performed by persons experienced in judging the textural properties of a sheet. The higher the number the softer the tissue.

Undispersed Eucalyptus Layered Sheet—The data indicates a 20.4% reduction in CD-strength with calendering (580.5 grams to 462.3 grams) and an additional 6.8% from calendering and 1-side abrasion (462.3 grams to 431) grams with an additional a 9.7% reduction from 2-side abrasion and the second winding process (431 grams to 389.1 grams). Through the entire process from sheet to a final produced calendered and two-sided abrasion, the sheet saw a 33% reduction in CD-strength (580.5 grams to 389.1 grams).

Blended Fiber Sheet—The data indicates a 18% reduction in CD-strength with calendering (563.1 grams to 461.7 grams) and an additional 2.1% from calendering and 1-side abrasion (461.7 grams to 452 grams) with an additional a 12.8% reduction from 2-side abrasion and the second winding process (452 grams to 394.1 grams). Through the entire process from sheet to a final produced calendered and two-sided abrasion, the sheet saw a 30% reduction in CD-strength (563.1 grams to 394.1 grams).

100% (long fiber) LL19 Sheet—The data indicates a 32.7% reduction in CD-strength with calendering (599.5 grams to 403.2 grams) and an additional 12.9% from calendering and 1-side abrasion (403.2 grams to 351.3 grams) with an additional a 23.5% decrease from 2-side abrasion and the second winding process (351.3 grams to 268.6 grams). Through the entire process from sheet to a final produced calendered and two-sided abrasion, the sheet saw a 55.2% reduction in CD-strength (599.5 grams to 268.6 grams).

Layered Fiber Centerline Sheet—The data indicates a 28% reduction in CD-strength with calendering (683 grams to 491.8 grams) and an additional 5.1% from calendering and 1-side abrasion (491.8 grams to 466.7 grams) with an additional a 9.7% reduction from 2-side abrasion and the second winding process (466.7 grams to 421.6 grams). Through the entire process from sheet to a final produced calendered and two-sided abrasion, the sheet saw a 38.3% reduction in CD-strength (683 grams to 421.6 grams).

100% (long fiber) NB50 Sheet—The data indicates a 22.5% reduction in CD-strength with calendering (1005.4 grams to 778.9 grams) and an additional 12.6% from calendering and 1-side abrasion (778.9 grams to 681 grams) with an additional a 10.3% reduction from 2-side abrasion and the second winding process (681 grams to 611.1 grams). Through the entire process from sheet to a final produced calendered and two-sided abrasion, the sheet saw a 39.2% reduction in CD-strength (1005.4 grams to 611.1 grams).

Between a 4.5 to 6.7% reduction in the MD-stretch occurs with calendering only. An additional 0.7 to 2.2% reduction in MD-stretch occurs from calendering and 1-side abrasion. Because the process on the pilot plant as configured, was only capable of abrading one side of the sheet at a time, the roll was converted as a one-side abraded roll and wound up on the reel. It was then removed and replaced on the unwind and run though the converting process and abraded a second time. Because the product goes through the winder a second time, it is theorized that the sheet will lose a certain percent of basis weight, caliper, strength and stretch due strictly from the winding process itself. Hence, when the sheet was abraded a second time to the fabric side of the sheet, the sheet experienced an additional 1.4 to 3.2% reduction in MD-stretch. In commercial applications two sided abrading could be conducted simultaneously either off-machine or on the machine, thereby eliminating one or both of the rewinding steps.

Figure 17:
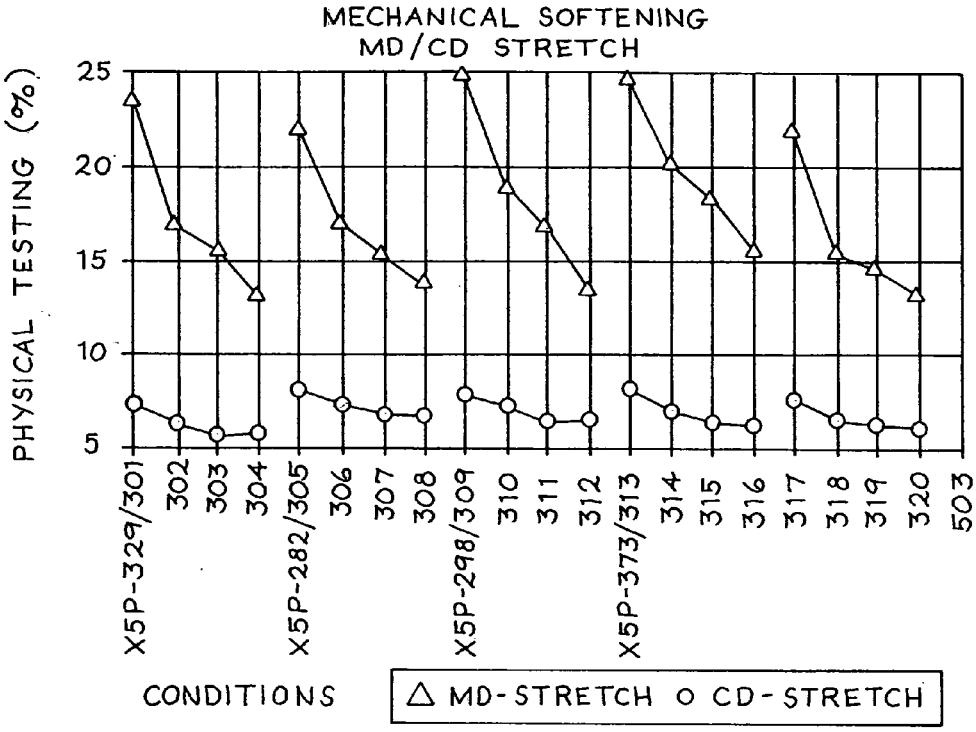
FIG. 17 is a graph charting data.

Changes in MD-stretch for particular types of sheets are as follows, and are also set forth in the data set out in XI and charted in FIG. 17.

TABLE XI

| MD/CD Stretch | | | |
|---|---|---|---|
| Base Sheet Type | Code # | MD Stretch | CD Stretch |
| Undisp. Eucalyptus | | | |
| Base Sheet | 301 | 23.6 | 7.3 |
| Calender Only | 302 | 16.9 | 6.3 |
| abrade 1-Side | 303 | 15.6 | 5.6 |
| abrade 2-Side | 304 | 13.2 | 5.7 |
| Blended | | | |
| | 305 | 22.1 | 8.0 |
| | 306 | 17.0 | 7.2 |
| | 307 | 15.4 | 6.7 |
| | 308 | 13.7 | 6.6 |
| 100% LL-19 (Softwood) | | | |
| | 309 | 24.9 | 7.7 |
| | 310 | 18.9 | 7.1 |
| | 311 | 16.7 | 6.3 |
| | 312 | 13.5 | 6.4 |
| Centerline | | | |
| | 313 | 24.6 | 8.0 |
| | 314 | 20.1 | 6.9 |
| | 315 | 18.3 | 6.3 |
| | 316 | 15.6 | 6.2 |
| 100% NB-50 (Softwood) | | | |
| | 317 | 21.9 | 7.5 |
| | 318 | 15.4 | 6.5 |
| | 319 | 14.7 | 6.2 |
| | 320 | 13.3 | 6.0 |

Undispersed Eucalyptus Layered Sheet—The data indicates a 6.7% reduction in MD Stretch with calendering and an additional 1.3% from calendering and 1-side abrasion with an additional a 2.4% reduction from 2-side abrasion and the second winding process. Through the entire process from sheet to a final produced calendered and two-sided abrasion, the sheet saw a 10.4% reduction in MD-stretch.

Blended Fiber Sheet—The data indicates a 5.1% reduction in MD-stretch with calendering and an additional 1.6% from calendering and 1-side abrasion with an additional a 1.7% reduction from 2-side abrasion and the second winding process. Through the entire process from sheet to a final produced calendered and two-sided abrasion, the sheet saw a 8.4% reduction in MD-stretch.

Layered Fiber Centerline Sheet—The data indicates a 4.5% reduction in MD-stretch with calendering and an additional 1.8% from calendering and 1-side abrasion with an additional a 2.7% reduction from 2-side abrasion and the second winding process. Through the entire process from the sheet to a final produced calendered and two-sided abrasion, the sheet saw a 9% reduction in MD-stretch.

100% (long fiber) NB50 Sheet—The data indicates a 6.5% reduction in MD-stretch with calendering and an additional 0.75% from calendering and 1-side abrasion with an additional a 1.4% reduction from 2-side abrasion and the second winding process. Through the entire process from sheet to a final produced calendered and two-sided abrasion, the sheet saw a 8.6% reduction in MD-stretch.

Set-up parameters that should be consider for the mechanical softening process can be as follows.

Gap between the abrasion roll and backing roll—a minimum gap attainable without sloughing of the fibers on the surface of the sheet is preferred. For tissue sheets this should be within a range from about 0.005"–0.101" gap depending on the sheet configuration.

Abrasion roll speed—Abrasion roll speed should be at its maximum. In pilot plant analysis, the critical speed of the abrasion roll was 4500 fpm, so that the maximum speed ratio was two times the maximum web speed of 2200 fpm on the pilot plant equipment. In commercial equipment this limitation should not be present. The speed ratio effect, i.e., increased loose fiber ends as the ratio between the abrasion roll and the web becomes larger, is believed to be explained by the increased contact area that the abrasion roll has with the web as roll speed increases relative to the web. Thus, the abrasion roll does more work to the web, breaking more bonds. Further the additional bonds that are broken, appear to be internal to the sheet, resulting in a reduction of stiffness.

Calendering—Abrading before or after calendering has varying effects on sheet properties. It is theorized that this effect may be due to an increased amount of work being induced to the non-calendered sheet. The stiffer non-calendered sheet creates more force against the abrasion roll. This was also shown by increased abrasion roll motor load for the abrasion before calendering condition.

Surface roughness of the abrasion roll—Dust, runnability, and the amount of loose fiber ends are effected by the roughness of the abrasion roll. A tungsten carbide coated roll from "ATCAM Inc." part number ATCAM-100-250 can be used. Although other coatings and type of abrasive materials may be used. For example anything from a sandpaper type abrasion roll to a knurled metal roll, to any roll with a textured surface may be employed.

Figure 5:
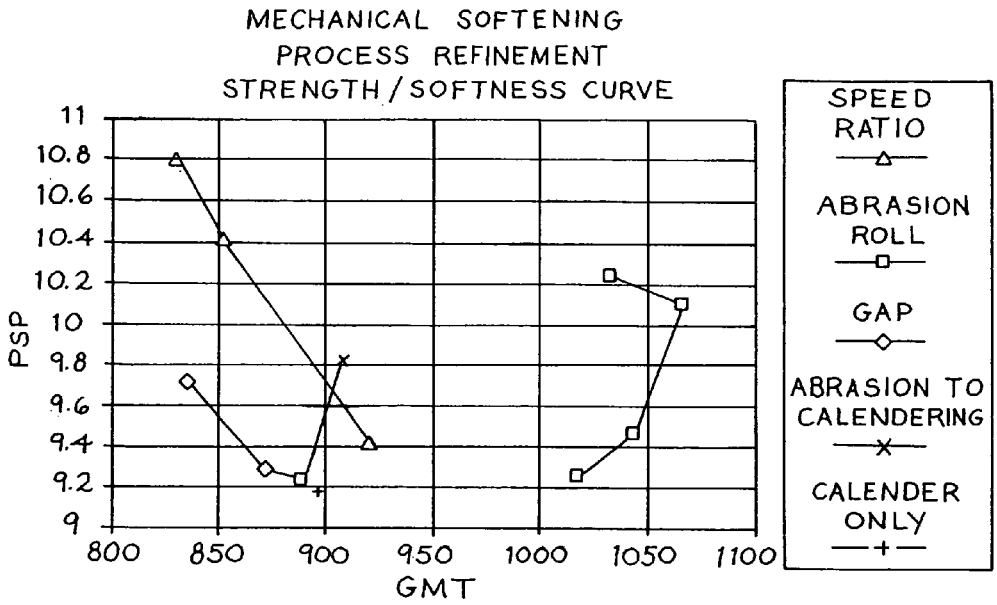
FIG. 5 is a graph charting data.

Using these parameters as shown in the data set out in Table XII and charted in FIG. 5, the process was capable of increasing the fuzziness, reducing the grittiness, and reducing the stiffness. All are attributes in improving the overall softness of a given tissue sheet. As used herein the term "GMT" is equal to the square root of the sum of the MD-strength multiplied by the CD-strength.

TABLE XII

| | Variable Modified | PSP | GMT |
|---|---|---|---|
| Speed Ratio | 1.25 | 9.41 | 923.1 |
| Speed Ratio | 1.5 | 10.40 | 854.2 |
| Speed Ratio | 2.0 | 10.80 | 832.7 |
| Abrasion Roll | 250 Ra | 9.24 | 1017.8 |
| Abrasion Roll | 125 Ra | 9.46 | 1043.5 |
| Abrasion Roll | 400 Ra | 10.10 | 1065.4 |
| Abrasion Roll | 250 Ra w/S | 10.21 | 1032.2 |
| Gap | 0.006 | 9.72 | 835.8 |
| Gap | 0.008 | 9.28 | 873.2 |
| Gap | 0.010 | 9.24 | 890.6 |
| Abrasion to Calendering | Before | 9.24 | 890.6 |
| | After | 9.82 | 909.0 |
| Calender Only Centerline | | 9.18 | 896.8 |

Figure 18:
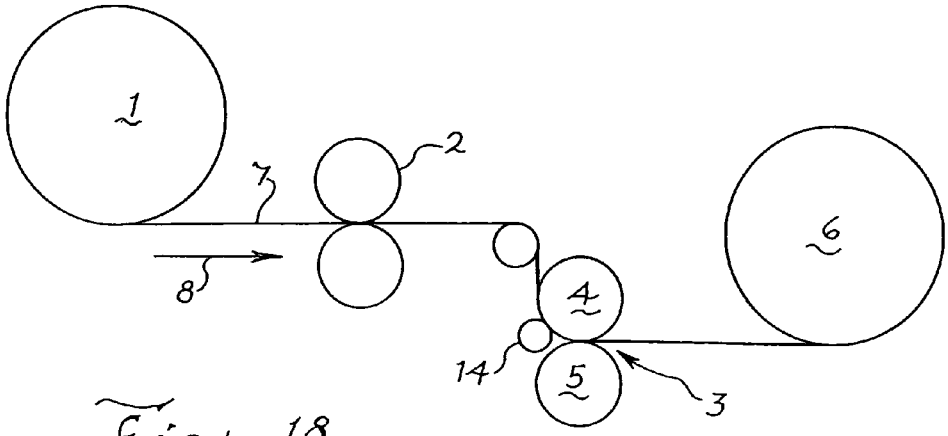
FIG. 18 is a schematic of an alternative embodiment of an abrading apparatus and process flow.
Figure 19:
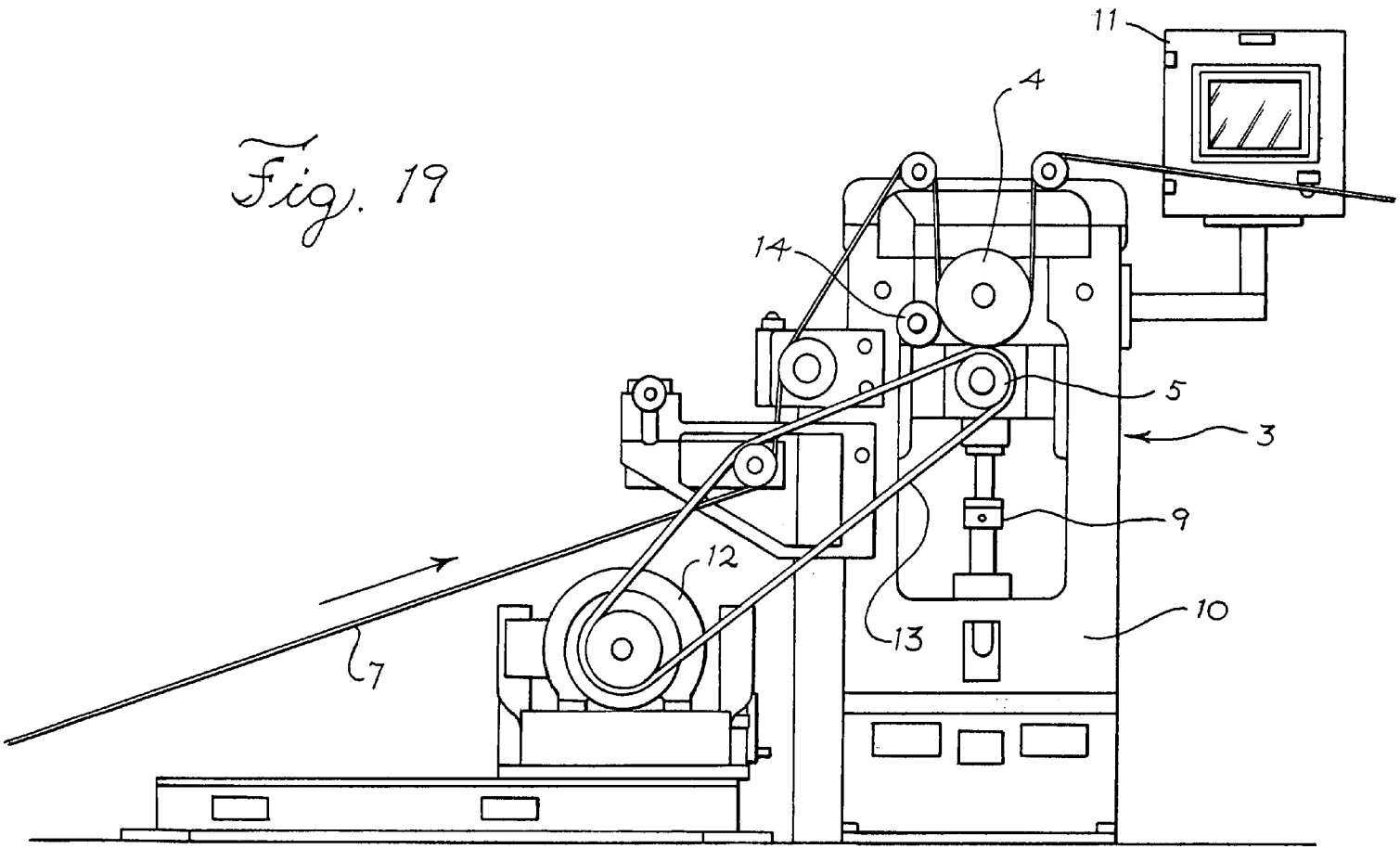
FIG. 19 is a schematic of the abrasion unit of FIG. 18.

Examples 1 to 4 used a mechanical softening apparatus that is configured like that shown in FIGS. 18 and 19. That apparatus has an unwinder 1, a calender 2, an abrasion unit 3, and a rewinder 6. FIG. 19 shows a detail view of an abrasion unit. Like numbers correspond to like structures between these two figures. The abrasion unit has a frame 10 that supports a backing roll 4, an abrasion roll 5, a nip roll 14 and a control unit 11. The abrasion unit also has an apparatus 9 to adjust the gap between the backing roll and the abrasion roll and apparatus (not shown) to impart a load to the nip between the backing and abrasion rolls (the abrasion nip) and the nip between the nip roll and the backing roll. The backing roll 4 is a 90 durometer shore "A", neoprene covered roll and is driven at line speed by a motor that is not shown in the figures. The abrasion roll 5 is mounted below the backing roll 4 and driven by belt 13 and motor 12. The abrasion roll 5 can be driven in the same or opposite direction as the movement of sheet 7. As configured in FIGS. 18 and 19, the sheet 7 moves in the direction of arrow 8.

The embodiment shown in FIG. 18 is configured to perform abrasion after calendering. To perform abrasion before calendering the calender 2 is moved down stream from the abrasion unit 3 and placed between that unit and the rewinder.

EXAMPLE 1

A sheet having the following properties: base weight of 28 g/m2; basesheet caliper of 0.026"; 3 layer; outer layers 25% (each) dispersed eucalyptus (hardwood) fibers; and center 50% spruce (softwood) fibers, is mechanically abraded on the mechanical abrasion apparatus at speeds from 500 fpm to 2200 fpm. These speeds should not be viewed as a limit on commercial speeds for this process.

Four different Tungsten Carbide coated rolls abrasion rolls are used: 250 Ra; 250 Ra with silicon; 125 Ra; and, 400 Ra. These rolls were flame coated with a tungsten carbide coating by ATCAM, Inc. The process is run with the following conditions and variations. The gap between the backing roll and the abrasion roll is set at 0.024" to 0.006". The speed of the abrasion roll is 1.136 to 3 times the line speed rotating in the same direction as the sheet. One-side abrasion is utilized to the air-side and the fabric side of the sheet. Two-side abrasion is utilized against both sides of the sheet. The nip roll is position prior to the abrasion nip (shown in FIG. 19) and at the exit of the abrasion nip (not shown) and is loaded at pressures from 5.0 to 0 pli. Calendering after abrasion is loaded at approximately 20 pli to achieve a finished sheet caliper of 0.013–0.014". Calendering before abrasion is loaded at approximately 20 pli to achieve a finished sheet caliper of 0.012–0.013".

Improvements in softness as it relates to gritty, grainy, stiffness, and fuzzy characteristics with minimal reduction in MD & CD strengths and caliper are obtained in both physical and softness panel testing. No noticeable softness improvements between abrading after calendering at 0.006" gap and abrading before calendering at 0.008" gap are observable. Abrading before calendering tends to improve softness but at the loss of strength and stretch. The abrasion process after calendering appears to provided a more even lifting of fibers over the entire sheet. A build-up of fibers on the abrasion roll is not an issue for any of the tested roll coatings. Dust generation increases when the size or gap of the abrasion nip is decreased and when the speed of the abrasion roll is increased. A minimum nip pressure of 0.8 pli between the nip roller and the backing roll is required prior to the abrasion nip. When abrading one side only, abrading the air-side of the sheet greatly reduces the two-sidedness of the finished sheet.

EXAMPLE 2

An uncreped through air dried sheet similar to that used in Example 1 is mechanically surface softened.

The softening is conducted at speeds of about 2200 fpm, which should not be viewed as a limit on the commercial speeds for this process, and with the following conditions and variations. The abrasion roll is a 250 Ra Tungsten Carbide coated. The softening process is run with the gap between the backing roll and the abrasion roll set at 0.005" to 0.009". The speed of the abrasion roll is 1.5 and 2 times the line speed rotating the same direction as the sheet One-side abrasion is utilized to the air-side of the sheet. Two-side abrasion is utilized against both sides of the sheet. The nip roll is set prior to the abrasion nip and loaded at 0.8 pli. Calendering after abrasion was loaded to 25 pli and 200 pli. Calendering before abrasion was loaded to 25 pli and 200 pli. Abrasion is also conducted with no calendering.

The effects of mechanical softening greatly enhances when preceded by an optimized calendering process. Mechanical softening is able to deliver a greater advantage when the gap between the abrasion roll and backing roll is reduced to a minimum. Mechanical softening is also able to deliver a greater advantage when the speed of the abrasion roll relative to the backing roll is increased to its maximum.

EXAMPLE 3

A creped through air dried sheet having the following properties: basis weight of 15.2 lbs./2880 ft.$^2$ bone dry; 4 layer base sheet with hardwood on the outer layer and softwood and broke in the inner layers; and a caliper of about 0.007" is mechanically softened. The percent of long fibers within the outer layers of this sheet were changed from 0% to 25% and up to 50%.

The mechanical softening is conducted at speeds of about 2200 fpm, which should not be viewed as a limit on the commercial speeds for this process. The abrasion roll is a 250 Ra Tungsten Carbide coated. The softening process is run with the gap between the backing roll and the abrasion roll at 0.006". The speed of the abrasion roll is 1.5 and 2 times the line speed rotating the same direction as the sheet.

Softness is improved, however, the improvement in softness is not as significant as in examples 1 and 2. The amount of dust generated during the process is reduced as the level of softwood fibers increase in the outer layers.

EXAMPLE 4

Four uncreped through air dried sheets having a basis weight of about 17–18 lbs/2880 ft$^2$ and a caliper of about 0.023–0.024 inches are mechanically softened. The first has a fiber distributions as in FIG. 11, with the 66% dispersed eucalyptus and 34% LL19 fibers blended through the sheet. The second sheet is 100% softwood. The third sheet has undispersed fibers in the outside layers, having 33% undispersed eucalyptus located in the air side layer, 34% LL19 fibers located in center layer, and 33% dispersed eucalyptus located in fabric side layer. The fourth sheet is a blended sheet with various levels of the C6001 debonder, which is manufactured by Witco and is an Imidazolene type debonder.

The mechanical softening is conducted at speeds of about 2200 fpm, which should not be viewed as a limit on the commercial speeds for this process. The abrasion roll is a 25O Ra Tungsten Carbide coated roll.

The softening process is run with the gap between the backing roll and the abrasion roll at 0.006." The speed of the abrasion roll is two times (4400 fpm) the line speed (2200 fpm) rotating in the same direction as the sheet. Abrasion is after calendering. Calendering is loaded to achieve a finished sheet caliper of 0.014–0.015" (30–35 pli). One-side abrasion is utilized against the air-side of the sheet. Two-side abrasion is utilized against both sides of the sheet.

Single-side abrasion has some improvement in the strength-softness curve for each sheet. Two-side abrasion significantly improved the strength-softness curve for each sheet. Layering of the fibers within the sheet improves the softness with minimal losses to the strength and stretch of the sheet. 100% softwood fiber sheets show strength losses due to the strength of the sheet comprised within the three layers of the sheet verses the centerline sheet where the strength was comprised mostly within the center layer. It is theorized that this occurs because the process yields the most work to the outside surfaces of the sheet.

Examples 5 to 59 are illustrative of a number of different variables that can be controlled in this process, and the effect on the final product that these variables may have. These examples, as with examples 1 to 4, were conducted at ambient temperature and moisture. The variables that were evaluated include: the size of the gap between the backing or base roll and the abrasion roll; the speed ratio between the abrasion roll and the web or sheet; abrasion prior to calendering or after calendering; the loading, both the pressure and type of apparatus placed on the sheet against the backing roll; and, different abrasion roll surfaces. Although optimum conditions for any particular application may vary, and changes in one variable could change optimum conditions for another variable, these examples show several general parameters about the mechanical softening process.

The number of loose fiber ends on the surface of the web were increased by this process. The overall softness of the sheet was improved by this process.

The lower the gap between the rolls the greater the amount of loose fiber ends. The lower gap settings contact more surface area raising loose fiber ends across the entire surface of the web rather than just on the peaks. It is theorized that this maybe an important factor in improving softness on the air side of the sheet, because the valleys or low spots on the web are a higher percentage of the surface area on the air side of the sheet. It is noted, however, that the larger gap, abrading just the peaks of the sheet, gives rise to an important alternative embodiment of the invention.

The loss of MD strength and stretch was low. More of an effect on CD strength and stretch was noticed. Strength degradation from abrasion was not significant or severe until the gap reached 0.006" before calendering or 0.004" after calendering. It is theorized that these gaps are reaching the thickness of the sheet at any given point, or when flat, and that the sheet is being broken up internally rather than just on the surface. Stretch was also reduced at these gap settings.

The 250 Ra roll appeared to produce the best results. The 250 Ra roll with silicone did not provide any additional benefit and the silicone appeared to wear. The 400 Ra roll appeared to be too aggressive and produced large amounts of dust. The 125 Ra roll also produced large amounts of dust, possible in part due to the lack of void area between particles. Although dust build-up on any of the rolls was not an issue. If anything, the silicone coated roll had the most build-up.

Speed ratio, i.e., having the abrasion roll moving in the same direction as the backing roll and the sheet, appears to provide better results than speed differential, i.e., the abrasion roll moving slower than or in the opposite direction of the sheet. It is theorized that the speed ratio produces a constant contact distance with the abrasion roll against the sheet as the machine speed changes. A negative speed ratio (abrasion roll slower or turning opposite the web) is not optimal. Any web edge defects may cause the web to tear and breakout in the nip.

A nip roller used for holding the web against the base roll is more effective than using a brass plate against the web. Uneven loading may cause wrinkling of the web and poor caliper profile. Thus, the web should be held with even pressure against the base roll across the entire roll face.

The process may generate static electricity and if needed can be controlled by methods and apparatus known to those in the art.

Abrading the air side of a one-ply sheet could make that side comparable in softness to the fabric side eliminating the two sidedness of that sheet.

These examples illustrate that favorable conditions for tissue generally are an abrasion roll with a 250 Ra, a gap between the abrasion roll and backing roll of 0.006", abrading after calendering, and at a speed ratio of 1.5. Further, there was no noticeable improvement in softness between abrading after calendering at 0.006" gap and abrading before calendering at 0.008" gap. The limit for the gap setting appears to be 0.006" before calendering and 0.004" after calendering. The 0.006" gap for abrasion after calendering provides a more even lifting of loose fiber ends across the entire surface of the web, in the valley and on the peaks.

In Examples 5 to 9, a sheet having the following properties before mechanical softening: basis weight of about 17 lbs/2880 $ft^2$; 3 layers; outer layers about 25–30% dispersed hardwood (each); center layer about 40–50% softwood was used. The sheet caliper was 0.0255 inches. The nip roller was loaded at 2.3 pli nip loading on the base roll. A rubber base roll and a 250 Ra abrasion roll with no silicone release agent were used. Abrasion took place on the air side of the sheet only. Calendering took place after abrasion and was loaded at 20 pli. The machine draws for the mechanical softening apparatus were as follows: 1.3% from unwinder to abrasion unit; 1.2% from abrasion unit to calender; and 2.0% from calender to reel. With the exception of example 5, all other examples were run with the sheet and the abrasion roll traveling in the same direction. As a baseline the sheet was run through the softening apparatus without abrading the sheet and provided the following results:

| | |
|---|---|
| Caliper (one Sheet) = 13.0 (0.013") | |
| Caliper (10 Sheet) = 102 (0.102") | |
| MD = 1237 | Stretch = 18.6% |
| CD = 983 | Stretch = 6.9% |

As used herein data reported such as MD=1237 and CD=983 are strengths measured in grams/3".

EXAMPLE 5

Used a 0.024" gap between the base roll and abrasion roll. The speed of the abrasion roll was 2 times faster than the web speed with the direction of travel opposite the web. This arrangement caused the web to tear and breakout due to edge defects on the parent roll that created high stress points in the nip.

EXAMPLE 6

The following conditions were used and provided the following results:

| | |
|---|---|
| Gap = 0.024" | |
| Speed Ratio = 3.0 | |
| Web speed 500 fpm | |
| Caliper = 13.6 | |
| MD = 1207 | Stretch = 19% |
| CD = 943 | Stretch = 6.5% |

As used herein a caliper value such as 13.6 corresponds to 0.0136 inches.

EXAMPLE 7

The speed ratio was changed from 3 to 2.5 times the web speed. All other variables were held constant. There were noticeable loose fiber ends generated and the overall appearance of the sheet looked better than the 3.0 speed ratio. The following conditions were used and provided the following results:

| | |
|---|---|
| Gap = 0.024" | |
| Speed Ratio = 2.5 | |
| Web Speed = 500 fpm | |
| Caliper = 13.5 | |
| MD = 1196 | Stretch = 17.2% |
| CD = 1013 | Stretch = 6.6% |

EXAMPLE 8

The speed ratio was changed to 1.5 times the web speed. All other variables were held constant. No apparent change in the appearance of the sheet or operation of the apparatus was noted from the 2.5 times speed ratio. The following conditions were used and provided the following results:

| | |
|---|---|
| Gap = 0.024" | |
| Speed Ratio = 1.5 | |
| Web Speed = 500 fpm | |
| Caliper = 13.5 | |
| MD = 1224 | Stretch = 16.6% |
| CD = 1080 | Stretch = 6.5% |

EXAMPLE 9

The speed ratio was adjusted down to 1.136 times the web speed. No apparent change was noted from the no abrasion condition. Less dust was generated than at higher speed ratios. The following conditions were used and provided the following results:

| | |
|---|---|
| Gap = 0.024" | |
| Speed Ratio = 1.136 | |
| Web Speed = 500 fpm | |
| Caliper = 12.6 | |
| MD = 1246 | Stretch = 16.8% |
| CD = 1040 | Stretch = 6.4% |

In Examples 10 to 29 a sheet having a furnish similar to that used in Examples 5 to 9 was used. The sheet caliper before processing was 0.024", its MD strength was 1220 and stretch was 24.4%, its CD stretch was 1398 and its stretch was 6.2%. The nip roller was loaded at 2.3 pli nip loading on the base roll. A rubber base roll and a 250 Ra abrasion roll with no silicone release agent were used. The abrasion roll had a diameter of 7.0". The abrasion took place on the air side and fabric sides of the sheet as indicated in the examples. Calendering took place after abrasion and was loaded at 20 pli. The machine draws for the mechanical softening apparatus were similar to those for examples 5 to 9. The sheet and the abrasion roll were traveling in the same direction. As a baseline the sheet was run through the softening apparatus without abrading the sheet and provided the following results:

| | |
|---|---|
| Caliper (one Sheet) = 11.5 | |
| MD = 1220 | Stretch = 14.2% |
| CD = 1067 | Stretch = 5.6% |

EXAMPLE 10

The gap was reduced to 0.020". There was an increase in dust generated compared to the larger gap. There also appeared to be a reduction in two sidedness of the converted product.

| | |
|---|---|
| Gap = 0.020 | |
| Speed Ratio = 1.136 | |
| Web Speed = 500 fpm | |
| Air side abrasion | |
| Caliper = 11 | |
| MD = 1107 | Stretch = 12.57% |
| CD = 952 | Stretch = 6.2% |

EXAMPLE 11

The speed ratio was increased to 1.5. Dust generation increased from the conditions of example 10. The following conditions were used and provided the following results:

| | |
|---|---|
| Gap = 0.020" | |
| Speed Ratio = 1.5 | |
| Web Speed = 500 fpm | |
| Air side abrasion | |
| Caliper = 10.3 | |
| MD = 1144 | Stretch = 15.4% |
| CD = 942 | Stretch = 5.9% |

EXAMPLE 12

The speed ratio was increased to 2.5 times the base roll speed. The loose fiber ends generated on the web appeared to be better than those generated at the 1.5 speed ratio. The following conditions were used and provided the following results:

| | |
|---|---|
| Gap = 0.020" | |
| Speed Ratio = 2.5 | |
| Web Speed = 500 fpm | |
| Air side abrasion | |
| Caliper = 10 | |
| MD = 1218 | Stretch = 12.3% |
| CD = 955 | Stretch = 5.8% |

EXAMPLE 13

The speed ratio was increased to 3.0. Loose fiber ends on the web, however, appeared better at the 1.5 speed ratio. The dust build-up on the abrasion roll was faster than previous conditions. The following conditions were used and provided the following results:

| | |
|---|---|
| Gap = 0.020" | |
| Speed Ratio = 3.0 | |
| Web Speed = 500 fpm | |
| Air side abrasion | |
| Caliper = 12.1 | |
| MD = 1288 | Stretch = 16.2% |
| CD = 1089 | Stretch = 7.2 |

EXAMPLE 14

The following conditions were used and provided the following results:

| | |
|---|---|
| Gap = 0.016" | |
| Speed Ratio = 3.0 | |
| Web Speed = 500 fpm | |
| Air side abrasion | |
| Caliper = 10.8 | |
| MD = 1217 | Stretch = 13.3% |
| CD = 1129 | Stretch = 10.2% |

EXAMPLE 15

The following conditions were used and provided the following results:

| | |
|---|---|
| Gap = 0.016" | |
| Speed Ratio = 2.5 | |
| Web Speed = 500 fpm | |
| Air side abrasion | |
| Caliper = 10.9 | |
| MD = 1181 | Stretch = 12.3% |
| CD = 1129 | Stretch = 6.3 |

EXAMPLE 16

The following conditions were used and provided the following results:

| | |
|---|---|
| Gap = 0.016" | |
| Speed Ratio = 1.5 | |
| Web Speed = 500 fpm | |
| Air side abrasion | |
| Caliper = 10.9 | |
| MD = 1126 | Stretch = 13.5% |
| CD = 1043 | Stretch = 6.4% |

EXAMPLE 17

The following conditions were used and provided the following results:

| | |
|---|---|
| Gap = 0.016" | |
| Speed Ratio = 1.136 | |
| Web Speed = 500 fpm | |
| Air side abrasion | |
| Caliper = 10.2 | |
| MD = 1189 | Stretch = 12.8% |
| CD = 973 | Stretch = 6.2% |

EXAMPLE 18

The following condition were used and provide the following results:

| | |
|---|---|
| Gap = 0.016" | |
| Speed Ratio = 1.5 | |
| Web Speed = 500 fpm | |
| Fabric side abrasion | |
| Caliper = 10.9 | |
| MD = 1235 | Stretch = 12.8% |
| CD = 976 | Stretch = 6.2% |

EXAMPLE 19

The following conditions were used and provided the following results:

| | |
|---|---|
| Gap = 0.020" | |
| Speed Ratio = 1.5 | |
| Web Speed = 500 fpm | |
| fabric side abrasion | |
| Caliper = 10.5 | |
| MD = 1216 | Stretch = 12.9% |
| CD = 1076 | Stretch = 6.1% |

The dust generated at this gap size was distinctively less than at 0.016" gap.

EXAMPLE 20

The following conditions were used and provided the following results:

| | |
|---|---|
| Gap = 0.012" | |
| Speed Ratio = 1.5 | |
| Web speed = 500 fpm | |
| Air side abrasion | |
| Caliper = 11.0 | |
| MD = 1216 | Stretch = 13.4% |
| CD = 993 | Stretch = 5.8% |

EXAMPLE 21

The following conditions were used and provided the following results:

| | |
|---|---|
| Gap = 0.012" | |
| Speed Ratio = 1.5 | |
| Web Speed = 1000 fpm | |
| Air side abrasion | |
| Caliper = 13.3 | |
| MD = 1198 | Stretch = 15.9% |
| CD = 1100 | Stretch = 6.7% |

Caliper measurements were also taken after each machine section. The caliper after abrasion only was 22.7, after abrasion and calendering it was 14.2. The reduced gap again increased the amount of loose fiber ends.

EXAMPLE 22

The following conditions were used and provided the following results:

| | |
|---|---|
| Gap = 0.016" | |
| Speed Ratio = 1.5 | |
| Web Speed = 1000 fpm | |
| Air side abrasion | |
| Caliper = 12.7 | |
| MD = 1135 | Stretch = 15.0% |
| CD = 999 | Stretch = 5.8% |

EXAMPLE 23

The following conditions were used and provided the following results:

| | |
|---|---|
| Gap = 0.020" | |
| Speed Ratio = 1.5 | |
| Web Speed = 1000 fpm | |
| Air side abrasion | |
| Caliper = 13.3 | |
| MD = 1188 | Stretch = 16.3% |
| CD = 1032 | Stretch = 5.8% |

In Examples 24 to 29 the abrasion roll was changed to a 125 Ra roll and a 400 Ra roll as noted in the examples. These rolls had runouts of 0.002" on the drive side and 0.001" on the operator side. The roll diameters were 5.85".

EXAMPLE 24

The following conditions were used and provided the following results:

| 125 Ra roll | |
|---|---|
| Gap = 0.016" | |
| Speed Ratio = 1.5 | |
| Web Speed = 1000 fpm | |

-continued

| 125 Ra roll | |
|---|---|
| Air side abrasion | |
| Caliper = 13.7 | |
| MD = 1022 | Stretch = 16.4% |
| CD = 1110 | Stretch = 6.4% |

EXAMPLE 25

The following conditions were used and provided the following results:

| 125 Ra roll | |
|---|---|
| Gap = 0.020" | |
| Speed Ratio = 1.5 | |
| Web Speed = 1000 fpm | |
| Air side abrasion | |
| Caliper = 14.0 | |
| MD = 1141 | Stretch = 15.7% |
| CD = 1242 | Stretch = 6.0% |

EXAMPLE 26

The following conditions were used and provided the following results:

| 125 Ra roll | |
|---|---|
| Gap = 0.012' | |
| Speed Ratio = 1.5 | |
| Web Speed = 1000 fpm | |
| Air side abrasion | |
| Caliper = 14.0 | |
| MD = 1155 | Stretch = 17.1% |
| CD = 1080 | Stretch = 6.3% |

Dust generation for the 125 Ra roll appeared to be more than with the 250 Ra roll.

EXAMPLE 27

The following conditions were used and provided the following results:

| 400 Ra roll | |
|---|---|
| Gap = 0.012" | |
| Speed Ratio = 1.5 | |
| Web Speed = 1000 fpm | |
| Air side abrasion | |
| Caliper = 13.6 | |
| MD = 1156 | Stretch = 16.0% |
| CD = 944 | Stretch = 6.5% |

A greater amount of dust was generated with the 400 Ra roll than with the previous abrasion rolls.

EXAMPLE 28

The following conditions were used and provided the following results:

| 400 Ra roll | |
|---|---|
| Gap = 0.016' | |
| Speed Ratio = 1.5 | |
| Web Speed = 1000 fpm | |
| Air side abrasion | |
| Caliper = 12.6 | |
| MD = 1118 | Stretch = 15.2% |
| CD = 1161 | Stretch = 6.2% |

EXAMPLE 29

The following conditions were used and provided the following results:

| 400 Ra roll | |
|---|---|
| Gap = 0.020" | |
| Speed Ratio = 1.5 | |
| Web Speed = 1000 fpm | |
| Air side abrasion | |
| Caliper = 13.9 | |
| MD = 1066 | Stretch = 17.2% |
| CD = 1245 | Stretch = 5.9% |

It was observed that the motor load for the motor driving the abrasion roll decreased as the interference with the web decreased.

In Examples 30 to 34 a sheet properties similar to that used in Examples 10 to 29 was used. The nip roller was loaded at 2.3 pli nip loading on the base roll. A rubber base roll was used. A 250 Ra abrasion roll was used with silicone applied to it. The abrasion roll had a 7" diameter and a 0.001" run out. The abrasion took place on the air side of the sheet. Calendering took place after abrasion and was loaded at 20 pli. The machine draws for the mechanical softening apparatus were similar to those for examples 5 to 9. The sheet and the abrasion roll were traveling in the same direction. As a baseline the sheet was run through the softening apparatus without abrading and without calendering the sheet and provided the following results:

| | |
|---|---|
| Caliper (one sheet) = 18.9 | |
| MD = 1132 | Stretch = 20.6% |
| CD = 1243 | Stretch = 6.2% |

EXAMPLE 30

The following conditions were used and provided the following results:

| 250 Ra (w/silicone) | |
|---|---|
| Gap = 0.020 | |
| Speed Ratio = 1.5 | |
| Web Speed = 1000 fpm | |
| Caliper = 12.2 | |
| MD = 1115 | Stretch = 15.9% |
| CD = 1074 | Stretch = 6.5% |

Very little dust was generated under these conditions.

EXAMPLE 31

The following conditions were used and provided the following results:

| 250 Ra (w/silicone) | |
|---|---|
| Gap = 0.016" | |
| Speed Ratio = 1.5 | |
| Web Speed = 1000 fpm | |
| Caliper = 12.1 | |
| MD = 1159 | Stretch = 14.8% |
| CD = 1134 | Stretch = 6.2% |

EXAMPLE 32

The following conditions were used and provided the following results:

| 250 Ra (w/silicone) | |
|---|---|
| Gap = 0.012" | Abrasion roll current = 6.9 amps |
| Speed Ratio = 1.5 | Base roll current = 7.6 amps |
| Web Speed = 1000 fpm | |
| Caliper = 11.4 | |
| MD = 1170 | Stretch = 13.6% |
| CD = 1106 | Stretch = 6.6% |

The use of the 250 Ra with silicone generated much less dust than 125 or 400 Ra rolls.

EXAMPLE 33

The following conditions were used and provided the following results:

| 250 Ra (w/silicone) | |
|---|---|
| Gap = 0.008" | |
| Speed Ratio = 1.5 | |
| Web Speed = 1000 fpm | |
| Caliper = 11.3 | |
| MD = 1103 | Stretch = 13.3% |
| CD = 1163 | Stretch = 6.2% |

These condition provided an Increase in loose fiber ends and an improvement in softness compared to the other conditions using silicone on the abrasion roll.

EXAMPLE 34

The following conditions were used and provided the following results:

| 250 Ra (w/silicone) | |
|---|---|
| Gap = 0.008" | |
| Speed Ratio = 1.25 | |
| Web Speed = 1000 fpm | |
| Caliper = 12.0 | |
| MD = 1113 | Stretch = 13.9% |
| CD = 1106 | Stretch = 5.4% |

In Example 35 a sheet similar to that used in Examples 5 to 9 was used. The nip roller was loaded at 2.3 pli nip loading on the base roll. A rubber base roll was used. A 250 Ra abrasion roll was used with silicone applied to it. The abrasion roll had a 7" diameter and a 0.001" run out. The abrasion took place on the air side of the sheet. Calendering took place prior to abrasion and was loaded at 20 pli. The sheet and the abrasion roll were traveling in the same direction. As a baseline the sheet was run through the softening apparatus without abrading and provided the following results:

| | |
|---|---|
| Caliper (one Sheet) = 11.7 | |
| MD = 1060 | Stretch = 13.9% |
| CD = 1184 | Stretch = 6.8% |

EXAMPLE 35

The following conditions were used and provided the following results:

| 250 Ra w/silicone. | |
|---|---|
| Gap = 0.008" | |
| Speed Ratio = 1.5 | |
| Web Speed = 1000 fpm | |
| Caliper = 12.2 | |
| MD = 1114 | Stretch = 15.0% |
| CD = 1249 | Stretch = 5.8% |

In Example 36 to 52 a sheet having a furnish similar to that used in Examples 5 to 9 was used. The sheet caliper before processing was 0.028", its MD strength was 970 and stretch was 16.8%, its CD strength was 886 and its stretch was 9.7%. The nip roller was loaded at 2.3 pli nip loading on the base roll. A rubber base roll was used. A 250 Ra abrasion roll was used with (w/) and without (wo/) silicone applied to it as noted in the examples. The abrasion roll had a 7" diameter and a 0.001" run out. The abrasion took place on the air side and fabric side of the sheet as noted in the examples. Calendering took place before abrasion (except for examples 50 to 52 in which abrasion took place before calendering) and was loaded at 20 pli. The sheet and the abrasion roll were traveling in the same direction. The machine draws were −0.5% from the unwinder to the calender, 1.5% from the calender to the abrasion unit, and 0 from the abrasion unit to the reel. As a baseline the sheet was run through the softening apparatus without abrading the sheet and provided the following results:

| | |
|---|---|
| Caliper = 15.7 | |
| MD = 1048 | Stretch = 13.8% |
| CD = 784 | Stretch = 7.6% |

EXAMPLE 36

The following conditions were used and provided the following results:

| 250 Ra w/silicone | |
|---|---|
| Gap = 0.008" | |
| Speed Ratio = 1.5 | |
| Web Speed = 1000 fpm | |
| Air side abrasion | |
| Caliper = 13.6 | |
| MD = 960 | Stretch = 12.9% |
| CD = 716 | Stretch = 8.8% |

EXAMPLE 37

The following conditions were used and provided the following results:

| 250 Ra w/silicone | |
|---|---|
| Gap = 0.006" | |
| Speed Ratio = 1.5 | |
| Web Speed = 1000 fpm | |
| Air side abrasion | |
| Caliper = 15.3 | |
| MD = 989 | Stretch = 13.7% |
| CD = 753 | Stretch = 7.1% |

These conditions resulted in little dust generation.

EXAMPLE 38

The following conditions were used and provided the following results:

| 250 Ra w/silicone |
|---|
| Gap = 0.004" |
| Speed Ratio = 1.5 |
| Web Speed = 1000 fpm |

-continued

| 250 Ra w/silicone | |
|---|---|
| Air side abrasion | |
| Caliper = 16.0 | |
| MD = 885 | Stretch = 14.5% |
| CD = 707 | Stretch = 7.5% |

At this level the gap was getting small enough to appear to have too caused a large degradation of strength.

EXAMPLE 39

The following conditions were used and provided the following results:

| 250 Ra w/silicone | |
|---|---|
| Gap = 0.006" | |
| Speed Ratio = 2.0 | |
| Web Speed = 1000 fpm | |
| Air side abrasion | |
| Caliper = 15.4 | |
| MD = 994 | Stretch = 12.8% |
| CD = 756 | Stretch = 7.1% |

It appears that higher speed ratio resulted in reduced MD stretch.

EXAMPLE 40

The following conditions were used and provided the following results:

| 250 Ra w/silicone | |
|---|---|
| Gap = 0.006" | |
| Speed ratio = 1.25 | |
| Web Speed = 1000 fpm | |
| Air side abrasion | |
| Caliper = 17.6 | |
| MD = 1086 | Stretch = 16.0% |
| CD = 815 | Stretch = 7.2% |

EXAMPLE 41

The following conditions were used and provided the following results:

| 250 Ra w/silicone | |
|---|---|
| Gap = 0.006" | |
| Speed Ratio = 1.75 | |
| Web speed = 1000 fpm | |
| Air side abrasion | |
| Caliper = 16.3 | |
| MD = 1008 | Stretch = 15.1% |
| CD = 736 | Stretch = 7.6% |

EXAMPLE 42

The following conditions were used and provided the following results:

| 250 Ra roll (wo/silicone): | |
|---|---|
| Gap = 0.010" | |
| Speed Ratio = 1.5 | |
| Web speed = 1000 fpm | |
| Air side abrasion | |
| Caliper = 15.6 | |
| MD = 1096 | Stretch = 16.8% |
| CD = 865 | Stretch = 9.8% |

EXAMPLE 43

The following conditions were used and provided the following results:

| 250 Ra roll (wo/silicone): | |
|---|---|
| Gap = 0.008" | |
| Speed Ratio = 1.5 | |
| Web Speed = 1000 fpm | |
| Air side abrasion | |
| Caliper = 16.7 | |
| MD = 1053 | Stretch = 15.0% |
| CD = 895 | Stretch = 9.1% |

At these conditions a significant amount of dust was generated.

EXAMPLE 44

The following conditions were used and provided the following results:

| 250 Ra roll (wo/silicone): | |
|---|---|
| Gap = 0.006" | |
| Speed ratio = 1.5 | |
| Web Speed = 1000 fpm | |
| Air side abrasion | |
| Caliper = 16.5 | |
| MD = 1028 | Stretch = 14.5% |
| CD = 806 | Stretch = 7.4% |

EXAMPLE 45

The following conditions were used and provided the following results:

| 250 Ra roll (wo/silicone): |
|---|
| Gap = 0.006" |
| Speed ratio = 1.25 |

-continued

| 250 Ra roll (wo/silicone): | |
|---|---|
| Web Speed = 1000 fpm | |
| Air side abrasion | |
| Caliper = 16.3 | |
| MD = 960 | Stretch = 14.7% |
| CD = 854 | Stretch = 6.9% |

EXAMPLE 46

The following conditions were used and provided the following results:

| 250 Ra roll (wo/silicone). (The remaining examples all used a 250 Ra roll (wo/silicone)). | |
|---|---|
| Gap = 0.006" | |
| Speed ratio = 2.0 | |
| Web Speed = 1000 fpm | |
| Air side abrasion | |
| Caliper = 14.4 | |
| MD = 890 | Stretch = 11.9% |
| CD = 731 | Stretch = 6.7% |

EXAMPLE 47

The following conditions were used and provided the following results:

| | |
|---|---|
| Gap = 0.006" | |
| Speed ratio = 1.5 | |
| Web speed = 1000 fpm | |
| fabric side abrasion | |
| Caliper = 14.7 | |
| MD = 970 | Stretch = 13.6% |
| CD = 766 | Stretch = 6.6% |

EXAMPLE 48

The following conditions were used and provided the following results:

| | |
|---|---|
| Gap = 0.008" | |
| Speed Ratio = 1.5 | |
| Web Speed = 1000 fpm | |
| Fabric side abrasion | |
| Caliper = 15.5 | |
| MD = 960 | Stretch = 13.0% |
| CD = 735 | Stretch = 6.3% |

EXAMPLE 49

The following conditions were used and provided the following results:

| | |
|---|---|
| Gap = 0.010 | |
| Speed Ratio 1.5 | |
| Web Speed = 1000 fpm | |
| Fabric side abrasion | |
| Caliper = 14.4 | |
| MD = 1017 | Stretch = 13.6% |
| CD = 915 | Stretch = 10.3% |

EXAMPLE 50

Abrasion before calendering and the following conditions were used and provided the following results:

| | |
|---|---|
| Gap = 0.010" | |
| Speed Ratio = 1.5 | |
| Web Speed = 1000 fpm | |
| Fabric side abrasion | |
| Caliper = 15.2 | |
| MD = 992 | Stretch = 14.0% |
| CD = 833 | Stretch = 7.0% |

EXAMPLE 51

Abrasion before calendering and the following conditions were used and provided the following results:

| | |
|---|---|
| Gap = 0.008" | |
| Speed Ratio = 1.5 | |
| Web Speed = 1000 fpm | |
| Fabric side abrasion | |
| Caliper = 14.8 | |
| MD = 921 | Stretch = 12.8% |
| CD = 788 | Stretch = 7.5% |

EXAMPLE 52

Abrasion before calendering and the following conditions were used and provided the following results:

| | |
|---|---|
| Gap = 0.010" | |
| Speed Ratio = 1.5 | |
| Web Speed = 1000 fpm | |
| Fabric side abrasion | |
| Caliper = 15.3 | |
| MD = 944 | Stretch = 13.3% |
| CD = 764 | Stretch = 7.9% |

EXAMPLE 53

A sheet having similar properties to that used in examples 36 to 52 was abraded on both sides. Calendering took place before abrasion. The fabric side of the sheet was abraded under the same conditions as set out in example 49. The air side of the sheet was abraded under the following conditions and provided the following results:

| | |
|---|---|
| Gap = 0.006" | |
| Speed Ratio = 1.5 | |
| Web Speed = 1000 fpm | |
| Caliper = 12.0 | |
| MD = 1001 | Stretch = 14.7% |
| CD = 820 | Stretch = 7.2% |

EXAMPLE 54

A sheet having similar properties to that used in examples 36 to 52 was abraded on the air side. The load on the nip roller was reduced to 1.5 pli. The following conditions were used and provided the following results:

| | |
|---|---|
| Gap = 0.006" | |
| Speed Ratio = 1.5 | |
| Web Speed = 1000 fpm | |
| Caliper = 17.8 | |
| MD = 970 | Stretch = 18.9% |
| CD = 733 | Stretch = 7.8% |

The web after abrasion was not wrinkled but showed signs of puckering at the exit of the calender nip.

EXAMPLE 55

A sheet having similar properties to that used in examples 36 to 52 was abraded on the air side. The load on the nip roller was reduced to 0.8 pli. The following conditions were used and provided the following results:

| | |
|---|---|
| Gap = 0.006" | |
| Speed Ratio = 1.5 | |
| Web Speed = 1000 fpm | |
| Caliper = 17.7 | |
| MD = 930 | Stretch = 18% |
| CD = 830 | Stretch = 7.5% |

The web handled the same for this nip loading as for the loading in example 53.

EXAMPLE 56

A sheet having similar properties to that used in examples 36 to 52 was abraded on the air side with calendering before abrasion. The calender was loaded at 30 pli and the following conditions were used and provided the following results:

| | |
|---|---|
| Gap = 0.006" | |
| Speed Ratio = 1.5 | |
| Web Speed = 1000 fpm | |

-continued

| | |
|---|---|
| Caliper = 15.1 | |
| MD = 967 | Stretch = 17.1% |
| CD = 920 | Stretch = 8.1% |

EXAMPLE 57

A sheet having similar properties to that used in examples 36 to 52 was abraded on the air side with calendering before abrasion. The calender was loaded at 30 pli and the following conditions were used and provided the following results:

| | |
|---|---|
| Gap = 0.006" | |
| Speed Ratio = 1.5 | |
| Web Speed = 1500 fpm | |
| Caliper = 17.0 | |
| MD = 879 | Stretch = 16.9% |
| CD = 792 | Stretch = 7.9% |

Increased dust levels occurred as speed increased from that used in example 55.

EXAMPLE 58

A sheet having similar properties to that used in examples 36 to 52 was abraded on the air side with calendering before abrasion. The calender was loaded at 30 pli and the following conditions were used and provided the following results:

| | |
|---|---|
| Gap = 0.006" | |
| Speed Ratio = 1.5 | |
| Web Speed = 2000 fpm | |
| Caliper = 18.4 | |
| MD = 945 | Stretch = 19.4% |
| CD = 803 | Stretch = 7.5% |

Dust levels increased with speed.

EXAMPLE 59

A sheet having similar properties to that used in examples 36 to 52 was abraded on the air side with calendering before abrasion. The calender was loaded at 30 pli and the following conditions were used and provided the following results:

| | |
|---|---|
| Gap = 0.006" | |
| Speed Ratio = 1.5 | |
| Web Speed = 2200 fpm | |
| Caliper = 18.0 | |
| MD = 939 | Stretch = 18.5% |
| CD = 776 | Stretch = 7.7% |

The wet:dry ratio is simply the ratio of the wet tensile strength divided by the dry tensile strength. It can be expressed using the machine direction (MD) tensile strengths, the cross-machine direction (CD) tensile strengths, or the geometric mean tensile strengths (GMT).

The tensile tester is programmed (GAP) [General Applications Program], version 2.5, Systems Integration Technology Inc., Stoughton, Mass.; a division of MTS Systems Corporation, Research Triangle Park, N.C.) such that it calculates a linear regression for the points that are sampled from P1 to P2. This calculation is done repeatedly over the curve by adjusting the points P1 to P2 in a regular fashion along the curve (hereinafter described). The highest value of these calculations is the Max Slope and, when performed on the machine direction of the specimen, is called the MD Max Slope.

The tensile tester program should be set up such that five hundred points such as P1 and P2 are taken over a two and one-half inch (63.5 mm) span of elongation. This provides a sufficient number of points to exceed essentially any practical elongation of the specimen. With a ten inch per minute (254 mm/min) crosshead speed, this translates into a point every 0.030 seconds. The program calculates slopes among these points by setting the 10th point as the initial point (for example P1), counting thirty points to the 40th point (for example, P2) and performing a linear regression on those thirty points. It stores the slope from this regression in an array. The program then counts up ten points to the 20th point (which becomes P1) and repeats the procedure again (counting thirty points to what would be the 50th point (which becomes P2), calculating that slope and also storing it in the array). This process continues for the entire elongation of the sheet. The Max Slope is then chosen as the highest value from this array. The units of Max Slope are kg per three-inch specimen width. (Strain is, of course, dimensionless since the length of elongation is divided by the length of the jaw span. This calculation is taken into account by the testing machine program.)

We claim:

1. A method of making a sheet product having improved softness and rate of absorbency comprising:

obtaining a web of fibrous material in sheet form;

feeding the web into an abrasion apparatus comprising: a pressure device; a backing roll; and an abrasion roll, wherein the backing roll and the abrasion roll form an abrasion nip and the pressure device applies tension to the web to hold it against the backing roll; and, abrading a surface of the web with the abrasion roll so that the surface has abraded fibers and a PR/EL of greater than about 0.72;

wherein a sheet of the web having the abraded surface has a MD Max Slope of about 10 or less, the rate of absorbency of the sheet being greater than a sheet of similar composition but not having abraded fibers on its surface, and the amount of absorbency for the sheet being comparable to the similar non-abraded sheet.

2. The method of claim 1, in which the web comprises paper making fibers.

3. The method of claim 1, in which the abrasion roll has a surface roughness from about 125 Ra to about 400 Ra.

4. The method of claim 1, in which the abrasion roll has a surface roughness from about 125 Ra to about 400 Ra.

5. The method of claim 1, in which the abrasion apparatus is located on a paper machine.

6. A method of making a sheet product having improved softness and rate of absorbency comprising:

obtaining a web of fibrous material in sheet form;

feeding the web into an abrasion apparatus comprising: a pressure device; a backing roll; and an abrasion roll, wherein the backing roll and the abrasion roll form an abrasion nip and the pressure device applies tension to the web to hold it against the backing roll; and, abrading a surface of the web with the abrasion roll so that the surface has abraded fibers and a PR/EL of greater than about 0.72, wherein a sheet of the web having the abraded surface has a machine direction tensile strength of at least about 1000 grams per 3 inches and a cross-machine direction tensile strength of at least about 800 grams per 3 inches, the rate of absorbency of the sheet being greater than a sheet of similar composition but not having abraded fibers on its surface, and the amount of absorbency for the sheet being comparable to the similar non-abraded sheet.

7. The method of claim 6, in which the web comprises paper making fibers.

8. The method of claim 6, in which the abrasion roll has a surface roughness from about 125 Ra to about 400 Ra.

9. The method of claim 6, in which the abrasion roll has a surface roughness from about 125 Ra to about 400 Ra.

10. The method of claim 6, in which the abrasion apparatus is located on a paper machine.

* * * * *